US010359213B2

(12) United States Patent
Karkow et al.

(10) Patent No.: US 10,359,213 B2
(45) Date of Patent: Jul. 23, 2019

(54) METHOD FOR LOW NOX FIRE TUBE BOILER

(71) Applicant: CLEARSIGN COMBUSTION CORPORATION, Seattle, WA (US)

(72) Inventors: Douglas W. Karkow, Manchester, IA (US); Joseph Colannino, Oceanside, CA (US); Igor A. Krichtafovitch, Kirkland, WA (US); Robert E. Breidenthal, Seattle, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 0 days.

(21) Appl. No.: 15/215,401

(22) Filed: Jul. 20, 2016

(65) Prior Publication Data

US 2017/0010019 A1 Jan. 12, 2017

Related U.S. Application Data

(63) Continuation-in-part of application No. PCT/US2015/012843, filed on Jan. 26, 2015, and a (Continued)

(51) Int. Cl.
*F22B 9/12* (2006.01)
*F24H 1/20* (2006.01)

(Continued)

(52) U.S. Cl.
CPC ..... *F24H 1/205* (2013.01); *F23D 14/145* (2013.01); *F23M 9/06* (2013.01); *F24H 1/26* (2013.01);

(Continued)

(58) Field of Classification Search
CPC .. F22B 7/12; F22B 1/1884; F22B 9/12; F24H 1/287; F24H 1/36; F24H 1/206; F23D 14/02
See application file for complete search history.

(56) References Cited

U.S. PATENT DOCUMENTS 2,095,065 A 10/1937 Hays
2,604,936 A 7/1952 Kaehni et al.

(Continued)

FOREIGN PATENT DOCUMENTS

CN 2484481 4/2002
CN 1950646 4/2007

(Continued)

OTHER PUBLICATIONS

Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, p. 121-145.

(Continued)

*Primary Examiner* — Gregory A Wilson
(74) *Attorney, Agent, or Firm* — Christopher A. Wiklof; Nicholas S. Bromer; Launchpad IP, Inc.

(57) ABSTRACT

A fire tube boiler includes a perforated flame holder configured to hold a combustion reaction that produces very low oxides of nitrogen (NOx).

20 Claims, 11 Drawing Sheets

Related U.S. Application Data continuation-in-part of application No. PCT/US2014/057075, filed on Sep. 23, 2014, and a continuation-in-part of application No. PCT/US2014/016632, filed on Feb. 14, 2014, and a continuation-in-part of application No. PCT/US2014/016622, filed on Feb. 14, 2014.

(60) Provisional application No. 61/931,407, filed on Jan. 24, 2014, provisional application No. 61/887,741, filed on Oct. 7, 2013, provisional application No. 61/765,022, filed on Feb. 14, 2013.

(51) Int. Cl.

| | |
|---|---|
| ***F23M 9/06*** | (2006.01) |
| ***F24H 1/26*** | (2006.01) |
| ***F24H 1/28*** | (2006.01) |
| ***F24H 9/00*** | (2006.01) |
| ***F23D 14/14*** | (2006.01) |
| ***F24H 9/18*** | (2006.01) |

(52) U.S. Cl.

CPC ..... *F24H 1/285* (2013.01); *F24H 9/0015* (2013.01); *F24H 9/0026* (2013.01); *F24H 9/1836* (2013.01); *F23C 2203/20* (2013.01)

(56) References Cited

U.S. PATENT DOCUMENTS 2,635,813 A 4/1953 Schlenz
3,008,513 A 11/1961 Holden
3,306,338 A 2/1967 Wright et al.
3,324,924 A 6/1967 Hailstone et al.
3,638,621 A * 2/1972 Craig ..... F22B 7/14 122/140.1
3,848,573 A * 11/1974 Phillips ..... F22B 7/12 110/326
4,021,188 A 5/1977 Yamagishi et al.
4,081,958 A 4/1978 Schelp
4,111,636 A 9/1978 Goldberg
4,195,596 A * 4/1980 Scheifley ..... B01D 53/70 122/149
4,408,461 A 10/1983 Bruhwiler et al.
4,443,182 A 4/1984 Wojcieson et al.
4,473,349 A 9/1984 Kumatsu
4,483,673 A 11/1984 Murai et al.
4,519,770 A 5/1985 Kesselring et al.
4,588,373 A 5/1986 Tonon et al.
4,627,388 A * 12/1986 Buice ..... F22B 7/12 110/234
4,643,667 A 2/1987 Fleming
4,673,349 A 6/1987 Abe et al.
4,726,767 A 2/1988 Nakajima
4,752,213 A 6/1988 Grochowski et al.
4,773,847 A 9/1988 Shukla et al.
4,850,862 A 7/1989 Bjerklie
5,235,667 A 8/1993 Canfield et al.
5,326,257 A 7/1994 Taylor et al.
5,375,999 A 12/1994 Aizawa et al.
5,409,375 A 4/1995 Butcher
5,441,402 A 8/1995 Reuther et al.
5,511,516 A 4/1996 Moore, Jr. et al.
5,641,282 A 6/1997 Lee et al.
5,667,374 A 9/1997 Nutcher et al.
5,718,573 A 2/1998 Knight et al.
5,784,889 A 7/1998 Joos et al.
5,957,682 A * 9/1999 Kamal ..... F23D 14/36 431/115
5,993,192 A 11/1999 Schmidt et al.
6,159,001 A 12/2000 Kushch et al.
6,210,151 B1 4/2001 Joshi et al.
6,270,336 B1 8/2001 Terashima et al.
6,287,111 B1 9/2001 Gensler
6,499,990 B1 12/2002 Zink et al.
6,752,620 B2 6/2004 Heier et al.
6,997,701 B2 2/2006 Volkert et al.
7,137,808 B2 11/2006 Branston et al.
7,243,496 B2 7/2007 Pavlik et al.
7,410,288 B1 8/2008 Kelso et al.
8,851,882 B2 10/2014 Hartwick et al.
8,881,535 B2 11/2014 Hartwick et al.
8,911,699 B2 12/2014 Colannino et al.
9,151,549 B2 10/2015 Goodson et al.
9,209,654 B2 12/2015 Colannino et al.
9,243,800 B2 1/2016 Goodson et al.
9,267,680 B2 2/2016 Goodson et al.
9,284,886 B2 3/2016 Breidenthal et al.
9,289,780 B2 3/2016 Goodson
9,310,077 B2 4/2016 Breidenthal et al.
9,366,427 B2 6/2016 Sonnichsen et al.
9,371,994 B2 6/2016 Goodson et al.
9,377,188 B2 6/2016 Ruiz et al.
9,377,189 B2 6/2016 Ruiz et al.
9,377,190 B2 6/2016 Karkow et al.
9,377,195 B2 6/2016 Goodson et al.
9,388,981 B2 7/2016 Karkow et al.
2001/0046649 A1* 11/2001 Schutz ..... F23C 6/047 431/4
2002/0155403 A1 10/2002 Griffin et al.
2002/0197574 A1* 12/2002 Jones ..... F23C 6/047 431/8
2003/0054313 A1 3/2003 Rattner et al.
2004/0058290 A1 3/2004 Mauzey et al.
2004/0081933 A1 4/2004 St. Charles et al.
2005/0106520 A1 5/2005 Cornwell et al.
2005/0208442 A1 9/2005 Heiligers et al.
2006/0084017 A1 4/2006 Huebner et al.
2006/0141413 A1 6/2006 Masten et al.
2006/0292510 A1 12/2006 Krauklis et al.
2008/0124666 A1 5/2008 Stocker et al.
2008/0131824 A1 6/2008 Wahl et al.
2010/0126175 A1 5/2010 Kim et al.
2010/0178219 A1 7/2010 Verykios et al.
2011/0076628 A1 3/2011 Miura et al.
2011/0076629 A1* 3/2011 Mosiewicz ..... F23C 5/08 431/174
2012/0064465 A1 3/2012 Borissov et al.
2012/0116589 A1 5/2012 Schneider et al.
2012/0164590 A1* 6/2012 Mach ..... F23D 14/145 431/328
2012/0231398 A1 9/2012 Carpentier et al.
2013/0230810 A1 9/2013 Goodson et al.
2013/0260321 A1 10/2013 Colannino et al.
2013/0323655 A1 12/2013 Krichtafovitch et al.
2013/0323661 A1 12/2013 Goodson et al.
2013/0333279 A1 12/2013 Osler et al.
2013/0336352 A1 12/2013 Colannino et al.
2014/0051030 A1 2/2014 Colannino et al.
2014/0065558 A1 3/2014 Colannino et al.
2014/0076212 A1 3/2014 Goodson et al.
2014/0080070 A1 3/2014 Krichtafovitch et al.
2014/0162195 A1 6/2014 Lee et al.
2014/0162196 A1 6/2014 Krichtafovitch et al.
2014/0162197 A1 6/2014 Krichtafovitch et al.
2014/0162198 A1 6/2014 Krichtafovitch et al.
2014/0170569 A1 6/2014 Anderson et al.
2014/0170571 A1 6/2014 Casasanta, III et al.
2014/0170575 A1 6/2014 Krichtafovitch
2014/0170576 A1 6/2014 Colannino et al.
2014/0170577 A1 6/2014 Colannino et al.
2014/0186778 A1 7/2014 Colannino et al.
2014/0196368 A1 7/2014 Wiklof
2014/0196369 A1 7/2014 Wiklof
2014/0208758 A1 7/2014 Breidenthal et al.
2014/0212820 A1 7/2014 Colannino et al.
2014/0216401 A1 8/2014 Colannino et al.
2014/0227645 A1 8/2014 Krichtafovitch et al.
2014/0227646 A1 8/2014 Krichtafovitch et al.
2014/0227649 A1 8/2014 Krichtafovitch et al.
2014/0248566 A1 9/2014 Krichtafovitch et al.
2014/0255855 A1 9/2014 Krichtafovitch
2014/0255856 A1 9/2014 Colannino et al.

(56) References Cited

U.S. PATENT DOCUMENTS

| | | | |
|---|---|---|---|
| 2014/0272730 | A1 | 9/2014 | Krichtafovitch et al. |
| 2014/0272731 | A1 | 9/2014 | Breidenthal et al. |
| 2014/0287368 | A1 | 9/2014 | Krichtafovitch et al. |
| 2014/0295094 | A1 | 10/2014 | Casasanta, III |
| 2014/0295360 | A1 | 10/2014 | Wiklof |
| 2014/0335460 | A1 | 11/2014 | Wiklof et al. |
| 2015/0079524 | A1 | 3/2015 | Colannino et al. |
| 2015/0104748 | A1 | 4/2015 | Dumas et al. |
| 2015/0107260 | A1 | 4/2015 | Colannino et al. |
| 2015/0118629 | A1 | 4/2015 | Colannino et al. |
| 2015/0121890 | A1 | 5/2015 | Colannino et al. |
| 2015/0140498 | A1 | 5/2015 | Colannino |
| 2015/0147704 | A1 | 5/2015 | Krichtafovitch et al. |
| 2015/0147705 | A1 | 5/2015 | Colannino et al. |
| 2015/0147706 | A1 | 5/2015 | Krichtafovitch et al. |
| 2015/0219333 | A1 | 8/2015 | Colannino et al. |
| 2015/0226424 | A1 | 8/2015 | Breidenthal et al. |
| 2015/0241057 | A1 | 8/2015 | Krichtafovitch et al. |
| 2015/0276211 | A1 | 10/2015 | Colannino et al. |
| 2015/0276217 | A1 | 10/2015 | Karkow et al. |
| 2015/0276220 | A1 | 10/2015 | Karkow et al. |
| 2015/0285491 | A1 | 10/2015 | Karkow et al. |
| 2015/0316261 | A1 | 11/2015 | Karkow et al. |
| 2015/0330625 | A1 | 11/2015 | Karkow et al. |
| 2015/0338089 | A1 | 11/2015 | Krichtafovitch et al. |
| 2015/0345780 | A1 | 12/2015 | Krichtafovitch |
| 2015/0345781 | A1 | 12/2015 | Krichtafovitch et al. |
| 2015/0362177 | A1 | 12/2015 | Krichtafovitch et al. |
| 2015/0362178 | A1 | 12/2015 | Karkow et al. |
| 2015/0369476 | A1 | 12/2015 | Wiklof |
| 2015/0369477 | A1 | 12/2015 | Karkow et al. |
| 2016/0003471 | A1 | 1/2016 | Karkow et al. |
| 2016/0018103 | A1 | 1/2016 | Karkow et al. |
| 2016/0025333 | A1 | 1/2016 | Karkow et al. |
| 2016/0025374 | A1 | 1/2016 | Karkow et al. |
| 2016/0025380 | A1 | 1/2016 | Karkow et al. |
| 2016/0033125 | A1 | 2/2016 | Krichtafovitch et al. |
| 2016/0040872 | A1 | 2/2016 | Colannino et al. |
| 2016/0046524 | A1 | 2/2016 | Colannino et al. |
| 2016/0047542 | A1 | 2/2016 | Wiklof et al. |
| 2016/0091200 | A1 | 3/2016 | Colannino et al. |
| 2016/0109118 | A1 | 4/2016 | Krichtafovitch et al. |
| 2016/0123576 | A1 | 5/2016 | Colannino et al. |
| 2016/0123577 | A1 | 5/2016 | Dumas et al. |
| 2016/0138799 | A1 | 5/2016 | Colannino et al. |
| 2016/0138800 | A1 | 5/2016 | Anderson et al. |
| 2016/0161110 | A1 | 6/2016 | Krichtafovitch et al. |
| 2016/0161115 | A1 | 6/2016 | Krichtafovitch et al. |
| 2016/0215974 | A1 | 7/2016 | Wiklof |

FOREIGN PATENT DOCUMENTS

| | | |
|---|---|---|
| CN | 101294714 | 10/2008 |
| DE | 10 2009 028624 A1 | 2/2011 |
| EP | 0223691 A1 | 5/1987 |
| EP | 0478305 | 12/1997 |
| EP | 0844434 | 5/1998 |
| EP | 1916477 | 4/2008 |
| EP | 2738460 | 6/2014 |
| JP | 60-073242 | 4/1985 |
| JP | 06-026624 | 2/1994 |
| JP | H 07-48136 | 2/1995 |
| JP | 07-083076 | 3/1995 |
| JP | 2006-275482 | 10/2006 |
| WO | WO 1995/000803 | 1/1995 |
| WO | WO 2012/109499 | 8/2012 |
| WO | WO 2015/017084 | 2/2015 |
| WO | WO 2015/038245 | 3/2015 |
| WO | WO 2015/042566 | 3/2015 |
| WO | WO 2015/042614 | 3/2015 |
| WO | WO 2015/042615 | 3/2015 |
| WO | WO 2015/051136 | 4/2015 |
| WO | WO 2015/054323 | 4/2015 |
| WO | WO 2015/057740 | 4/2015 |
| WO | WO 2015/061760 | 4/2015 |
| WO | WO 2015/070188 | 5/2015 |
| WO | WO 2015/089306 | 6/2015 |
| WO | WO 2015/103436 | 7/2015 |
| WO | WO 2015/123149 | 8/2015 |
| WO | WO 2015/123381 | 8/2015 |
| WO | WO 2015/123670 | 8/2015 |
| WO | WO 2015/123683 | 8/2015 |
| WO | WO 2015/123694 | 8/2015 |
| WO | WO 2015/123696 | 8/2015 |
| WO | WO 2015/123701 | 8/2015 |
| WO | WO 2016/003883 | 1/2016 |
| WO | WO 2016/007564 | 1/2016 |
| WO | WO 2016/018610 | 2/2016 |
| WO | WO 2016/105489 | 6/2016 |

OTHER PUBLICATIONS

EPO Extended Search Report and Search Opinion of EP Application No. 15739931.2 dated Sep. 21, 2017.

PCT International Search Report and Written Opinion of PCT Application No. PCT/US2015/012843 dated May 7, 2015.

Fric, Thomas F., "Effects of Fuel-Air Unmixedness on NOx Emissions," Sep.-Oct. 1993. Journal of Propulsion and Power, vol. 9, No. 5, pp. 708-713.

Arnold Schwarzenegger, "A Low NOx Porous Ceramics Burner Performance Study," California Energy Commission Public Interest Energy Research Program, Dec. 2007, San Diego State University Foundation, p. 5.

M. Abdul Mujeebu et al., "Applications of Porous Media Combustion Technology—A Review." Applied Energy 86, 2009, pp. 1365-1375.

PCT International Search Report and Written Opinion of PCT/US2014/057075 dated Jan. 14, 2015.

PCT International Search Report and Written Opinion of PCT/US2014/016632 dated May 26, 2014.

PCT International Search Report and Written Opinion of PCT/US2014/016622 dated May 27, 2014.

* cited by examiner

METHOD FOR LOW NOX FIRE TUBE BOILER

CROSS REFERENCE TO RELATED APPLICATIONS

The present application is a U.S. Continuation-in-Part Application which claims priority benefit under 35 U.S.C. § 120 (pre-AIA) of International Patent Application No. PCT/US2015/012843, entitled "LOW NOx FIRE TUBE BOILER," filed Jan. 26, 2015, now expired; which claims priority benefit from U.S. Provisional Patent Application No. 61/931,407, entitled "LOW NOx FIRE TUBE BOILER," filed Jan. 24, 2014, now expired.

The present application also is a Continuation-in-Part of and claims priority to PCT Patent Application No. PCT/US2014/057075, entitled "HORIZONTALLY FIRED BURNER WITH A PERFORATED FLAME HOLDER," filed Sep. 23, 2014, now expired. PCT Patent Application No. PCT/US2014/057075 claims priority benefit from U.S. Provisional Patent Application No. 61/887,741, entitled "POROUS FLAME HOLDER FOR LOW NOx COMBUSTION", filed Oct. 7, 2013, now expired. PCT Patent Application No. PCT/US2014/057075 also is a Continuation-in-Part of and claims priority to PCT Patent Application No. PCT/US2014/016632, entitled "FUEL COMBUSTION SYSTEM WITH A PERFORATED REACTION HOLDER", filed Feb. 14, 2014, now expired.

The present application also is a Continuation-in-Part of and claims priority to PCT Patent Application No. PCT/US2014/016632, entitled "FUEL COMBUSTION SYSTEM WITH A PERFORATED REACTION HOLDER," filed Feb. 14, 2014, now expired. PCT Patent Application No. PCT/US2014/016632 claims priority benefit from U.S. Provisional Patent Application No. 61/765,022, entitled "PERFORATED FLAME HOLDER AND BURNER INCLUDING A PERFORATED FLAME HOLDER", filed Feb. 14, 2013, now expired. PCT Patent Application No. PCT/US2014/016632 also claims priority benefit from U.S. Provisional Patent Application No. 61/931,407, entitled "LOW NOx FIRE TUBE BOILER", filed Jan. 24, 2014, now expired.

The present application also is a Continuation-in-Part of and claims priority to PCT Patent Application No. PCT/US2014/016622, entitled "STARTUP METHOD AND MECHANISM FOR A BURNER HAVING A PERFORATED FLAME HOLDER," filed Feb. 14, 2014, now expired. PCT Patent Application No. PCT/US2014/016622 claims priority benefit from U.S. Provisional Patent Application No. 61/765,022, entitled "PERFORATED FLAME HOLDER AND BURNER INCLUDING A PERFORATED FLAME HOLDER", filed Feb. 14, 2013, now expired. PCT Patent Application No. PCT/US2014/016622 also claims priority benefit from U.S. Provisional Patent Application No. 61/931,407, entitled "LOW NOx FIRE TUBE BOILER", filed Jan. 24, 2014, now expired.

Each of the foregoing applications, to the extent not inconsistent with the disclosure herein, is incorporated by reference.

BACKGROUND

Fire tube boilers are used across a broad range of applications, most especially as package boilers that are offered as build-to-stock or build-to-order items that can be shipped complete to or ready for configuration at a user site. Package boilers are frequently used in industrial, commercial, and multi-unit residential applications to provide hot water or steam for a variety of uses.

FIG. 1 is a simplified diagram of a fire tube boiler 100 made according to the prior art. The fire tube boiler 100 includes a shell 102 having a front wall 103, a back wall 105, and a peripheral wall 107 configured to hold water 104. A combustion pipe 106 disposed at least partially inside the shell 102 defines a combustion volume 108 and holds the water 104 out of the combustion volume 108. The combustion pipe 106 can also be referred to as a morrison tube or furnace. A fuel nozzle 110 is disposed to receive fuel from a fuel source 112 and output a fuel jet into the combustion volume 108 and an air source 114 is disposed to output combustion air into the combustion volume 108. The air source 114 can consist essentially of a natural draft air source, or alternatively can receive air from a blower 116. Various fuels are used in commercially available fire tube boilers. For example, the boilers can use natural gas, propane, #2 fuel oil, and/or #6 fuel oil, alone or in combination.

The fuel jet and combustion air together support a conventional flame 118 in the combustion volume 108. The flame 118 produces hot flue gas that is circulated through fire tubes 120, 122 that, together with the wall of the combustion pipe 106, transfer heat produced by the combustion reaction 118 to the water 104. In the illustrative example 100, the fire tubes 120, 122 and the combustion pipe 106, form a three pass system with hot flue gas being produced in the combustion pipe 106 flowing from left to right, a second pass of fire tube 120 supporting flue gas flow from right to left, and a third pass of fire tubes 122 supporting flue gas flow from left to right. Each "turn" of flue gas direction is made in a plenum 124, 126. Various numbers of passes, for example between one (combustion pipe 106 only) and four, are typically used according to the design preferences for a given installation or standard product. The embodiment of FIG. 3 is referred to as a "dry back" boiler. In a "wet back" boiler, the plenum 124 has a wall separate from the back wall 105 with space for boiler water 104 to circulate therebetween.

Cooled flue gas is vented to the atmosphere through an exhaust flue 128. Optionally, the vented flue gas can pass through an economizer that pre-heats the combustion air, the fuel, and/or feed water 130 to the boiler 100. The water 104 can consist essentially of (hot) liquid water (e.g., except for boiling that may occur immediately adjacent to the heat transfer surfaces of the fire tubes 120, 122 and the combustion pipe 106), or can include liquid water and saturated steam 132. The output hot water or steam 132 is transported for use as a heat source for a variety of industrial, commercial, or residential purposes.

An automatic controller 134 may be used to control output of hot water or steam 132 according to demand received via a data interface 136. The controller 134 can control fuel flow using a fuel valve 138 and can control an air damper or blower 116 to match flame 118 heat output, and thereby control heat output to hot water or steam 132 demand. The controller 134 can further control a steam or hot water valve 140 and/or a feed water valve 142 to control the flow rate of water 104 through the boiler 100.

Although most fire tube boilers such as package boilers are relatively low thermal output compared to the range of industrial burners, and therefore can individually be relatively clean sources of hot water or steam 132, they collectively represent a significant source of air pollution owing to a relatively high number of installations.

What is needed is a burner technology that can be applied to a fire tube boiler that will produce a reduced output of pollutants including carbon monoxide (CO) and/or oxides of nitrogen (NOx).

SUMMARY

According to an embodiment, a low oxides of nitrogen (NOx) fire tube boiler includes a shell configured to hold water. At least one combustion pipe is disposed at least partially inside the shell, the combustion pipe being characterized by a length and an inside diameter, the combustion pipe surrounding a combustion volume and configured to hold the water out of the combustion volume. A fuel nozzle is disposed to output a fuel jet into the combustion volume defined by the combustion pipe. An air source is disposed to output combustion air into the combustion volume. A perforated flame holder is disposed in the combustion pipe, the perforated flame holder being aligned to receive the fuel jet and combustion air from the fuel nozzle and air source. The perforated flame holder includes a body that defines a plurality of void volumes operable to convey the fuel and air and to hold a combustion reaction supported by the fuel and air, the body further being configured to receive heat from the combustion reaction in the void volumes, hold the heat, and output the heat to the fuel and air in the void volumes to maintain combustion of a lean fuel and air mixture.

According to an embodiment, a method for operating a NOx fire tube boiler includes providing a boiler shell including at least one combustion pipe disposed at least partially inside the shell and a plurality of fire tubes disposed inside the shell, the plurality of fire tubes being configured to receive combustion products from the combustion pipe, the combustion pipe being characterized by a length and an inside diameter, the boiler shell being configured to hold boiler water, the combustion pipe surrounding a combustion volume and forming a continuous volume with the plurality of fire tubes, and the combustion pipe and fire tubes being configured to collectively hold the boiler water out of the combustion volume. A perforated flame holder is supported in the combustion pipe. The perforated flame holder includes a body that defines a plurality of void volumes operable to convey the fuel and air and to hold a combustion reaction. Fuel and combustion air is output into the combustion volume in a direction aligned to deliver mixed fuel and combustion air to the perforated flame holder. A combustion reaction supported by the fuel and combustion air is held with the perforated flame holder. Hot combustion products to the fire tubes, heat from the fire tubes is transferred to the boiler water, and hot water or steam is output from the boiler. The perforated flame holder causes output of combustion products including less than 10 parts per million NOx at 3% excess oxygen.

DETAILED DESCRIPTION

Figure 1:
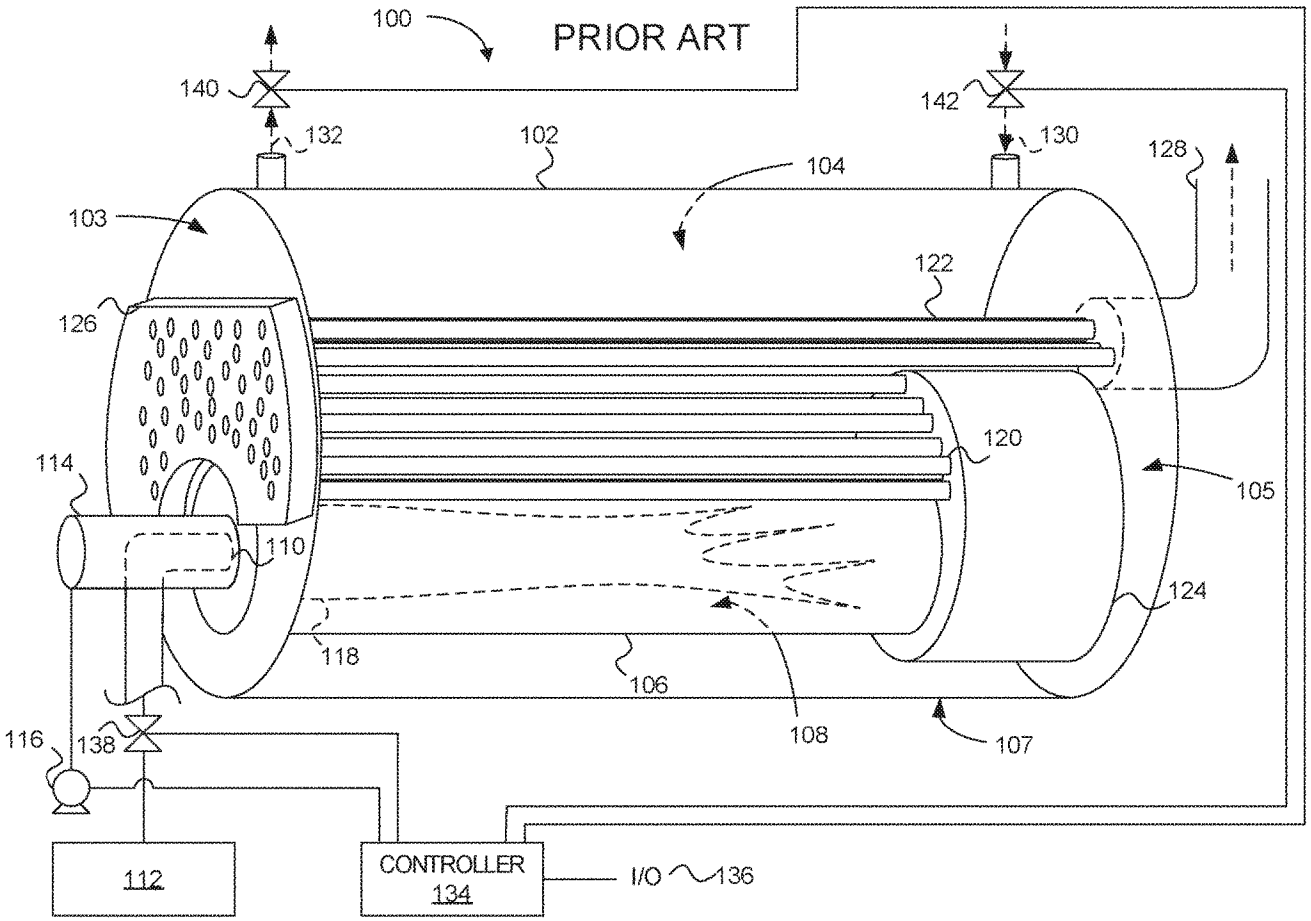
FIG. 1 PRIOR ART
FIG. 1 is a diagram of a fire tube boiler, according to the prior art.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

Referring again to FIG. 1, in a conventional fire tube boiler 100, the flame 118 is relatively uncontrolled. That is, the flame 118 can vary in conformation such that its shape and location at any particular point in time is relatively unpredictable. This unpredictability in location combines with high peak temperatures encountered especially at the stoichiometric interface (the visible surface) in a diffusion flame. Moreover, the length of the flame 118 causes a relatively long residence time during which the combustion air (including molecular nitrogen, $N_2$) is subject to high temperature.

The inventors recognize that to minimize output of oxides of nitrogen such as NO and $NO_2$ (collectively referred to as NOx) it is desirable to 1) minimize the peak flame temperature, and 2) minimize residence time at the peak flame temperature. Heretofore, technologies to minimize flame temperature have been unavailable or expensive and complex. Technologies to minimize residence time have similarly been unavailable or expensive and complex.

According to embodiments described herein, a fire tube boiler 100 is equipped with a perforated flame holder configured to support lean combustion that both minimizes peak flame temperature and reduces residence time at the flame temperature. Experiments have yielded NOx concentration in low single digit parts per million (ppm) in a fire tube boiler experimental apparatus.

Figure 2:
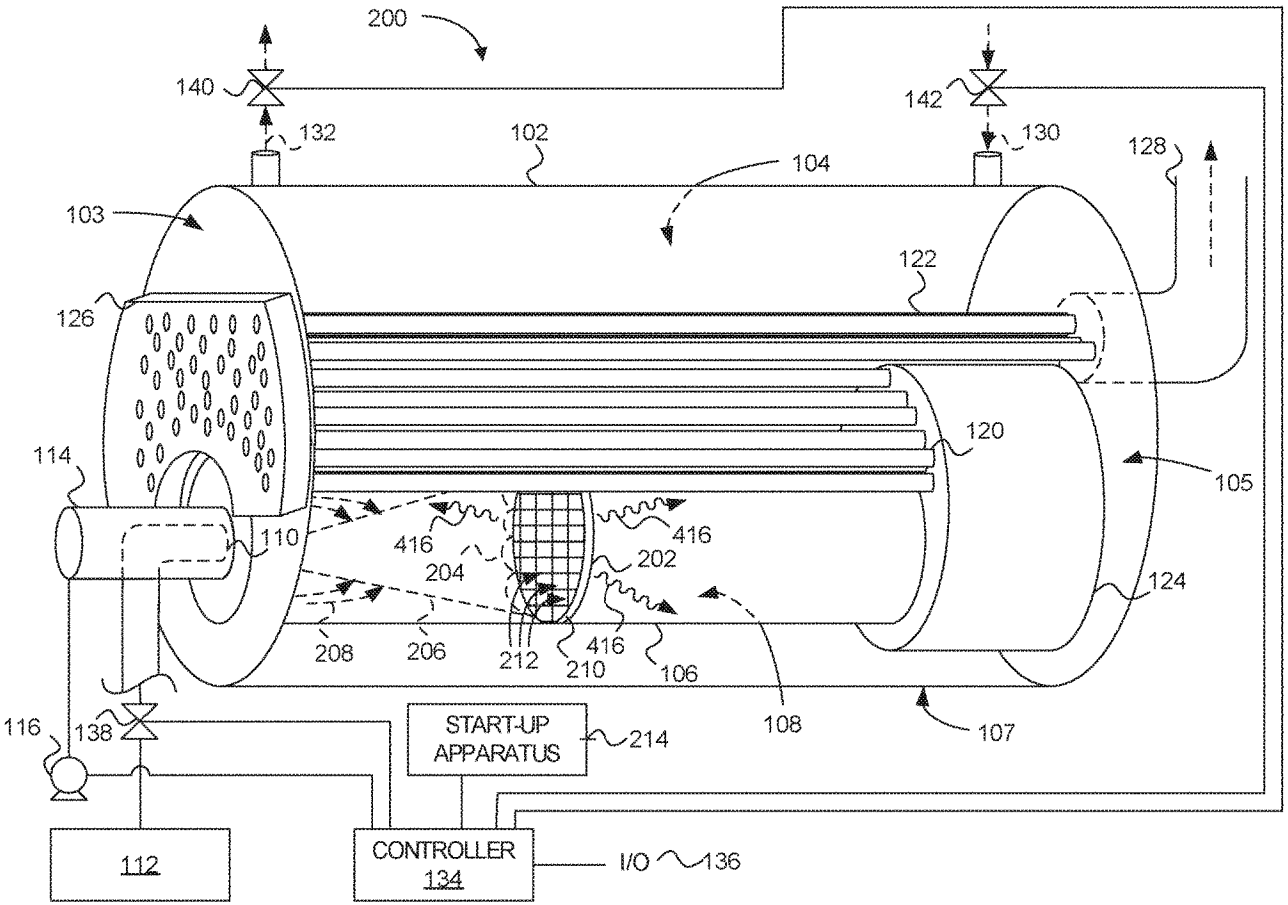
FIG. 2 is a diagram of a low oxides of nitrogen (NOx) fire tube boiler including a perforated flame holder, according to an embodiment.

FIG. 2 is a diagram of a low NOx fire tube boiler 200 including a perforated flame holder 202, according to an embodiment. The low NOx fire tube boiler 200 includes a shell 102 configured to hold water 104. At least one combustion pipe 106 is disposed at least partially inside the shell 102, the combustion pipe 106 is characterized by a length and an inside diameter, the combustion pipe 106 surrounds a combustion volume 108 and is configured to hold the water 104 out of the combustion volume 108. A fuel nozzle 110 is disposed to output a fuel jet 206 into the combustion volume 108 defined by the combustion pipe 106. Various fuels can be used. For example, the low NOx fire tube boiler 200 can use natural gas, propane, #2 fuel oil, and/or #6 fuel oil, alone or in combination. An air source 114 is disposed to output combustion air 208 into the combustion volume 108.

For ease of description, oxidant provided to react with the fuel 206 is referred to as air. The oxidant in this case is oxygen. Additionally or alternatively, another oxidant or another oxidant mixture can be substituted without departing from the spirit of the disclosure herein. However, since most or all fire tube boilers use air to supply oxidant, the convention is observed herein that the fluid that supplies oxidant to the combustion reaction is referred to as air.

The air source 114 can consist essentially of a natural draft air source, or alternatively can receive air from a blower 116. In one embodiment, the air 208 is output into the combustion volume 108 and is entrained by the fuel 206 after the fuel is output from the fuel nozzle 110 in the combustion volume 108. In another embodiment, the fuel nozzle outputs fuel 206 into air 208 in a premixing chamber included in the air source 114 before the air 208 enters the combustion volume 108. In another embodiment, the fuel nozzle outputs fuel 206 into air 208 directly into a portion of the air source 114 (before the air 208 enters the combustion volume 108) wherein the air source 114 does not include a specific premixing volume structure.

A perforated flame holder 202 is disposed in the combustion pipe 106. The perforated flame holder 202 is aligned to receive the fuel 206 and combustion air 208 from the fuel nozzle 110 and air source 114. The perforated flame holder 202 includes a body 210 defining a plurality of void volumes 212, each of the plurality of void volumes 212 supporting respective portions of a combustion reaction 204. The perforated flame holder 202 is described in much more detail below.

As depicted in FIG. 2 and elsewhere herein, the burner formed from the fuel nozzle 110, the air source 114 and the perforated flame holder 202 is horizontally fired. That is, the fuel 206 and air 208 (or alternatively a fuel/air mixture) have a mean propagation direction that is perpendicular to gravity. In other embodiments, the burner 110, 114, 202 can be fired in a different direction. For example a vertically fired boiler or a boiler fired in a non-horizontal and non-vertical direction are also contemplated by the inventors.

A combustion reaction held by the perforated flame holder 202 outputs heat in the form of thermal radiation 416 and in the form of heated flue gas. The thermal radiation 416 is output, in part, to the wall of the combustion pipe 106, which transfers received heat to the water 104. The heated flue gas is circulated through the combustion pipe 106 and fire tubes 120, 122 that, together with the wall of the combustion pipe 106, transfer convective heat from the heated flue gas to the water 104. In the illustrative example 200, the fire tubes 120, 122 and the combustion pipe 106 form a three pass system with hot flue gas being produced in the combustion pipe 106 flowing from left to right, a second pass of fire tubes 120 supporting flue gas flow from right to left, and a third pass of fire tubes 122 supporting flue gas flow from left to right. Each "turn" of flue gas direction is made in a plenum 124, 126. Various numbers of passes, for example between one (i.e., combustion pipe 106 only) and four, are typically used according to the design preferences for a given installation or for a standard product.

Cooled flue gas is vented to the atmosphere through an exhaust flue 128. Optionally, the vented flue gas can pass through an economizer that pre-heats the combustion air, the fuel, and/or feed water 130 to the boiler 200. The water 104 can consist essentially of (hot) liquid water (e.g., except for boiling that may occur immediately adjacent to the heat transfer surfaces of the combustion pipe 106 and fire tubes 120, 122), or can include liquid water and saturated steam 132. The output hot water or steam 132 is transported for use as a heat source for a variety of industrial, commercial, or residential purposes.

An automatic controller 134 may be used to control output of hot water or steam 132 according to demand received via a data interface 136. The controller 134 can control fuel flow using a fuel valve 138 and can control an air damper or blower 116 to match combustion reaction heat output, and thereby control heat output to hot water or steam 132 demand. The controller 134 can further control a steam or hot water valve 140 and/or a feed water valve 142 to control the flow rate of water 104 through the boiler 200.

Additionally or alternatively, the controller 134 can be operatively coupled to a boiler 102 start-up apparatus 214. One function of the boiler start-up apparatus 214 is to cause at least a portion of the perforated flame holder 202 to be heated to at or near an operating temperature when fuel 206 is output to the perforated flame holder 202. Boiler start-up apparatuses 214 are described in much more detail below.

Figure 3:
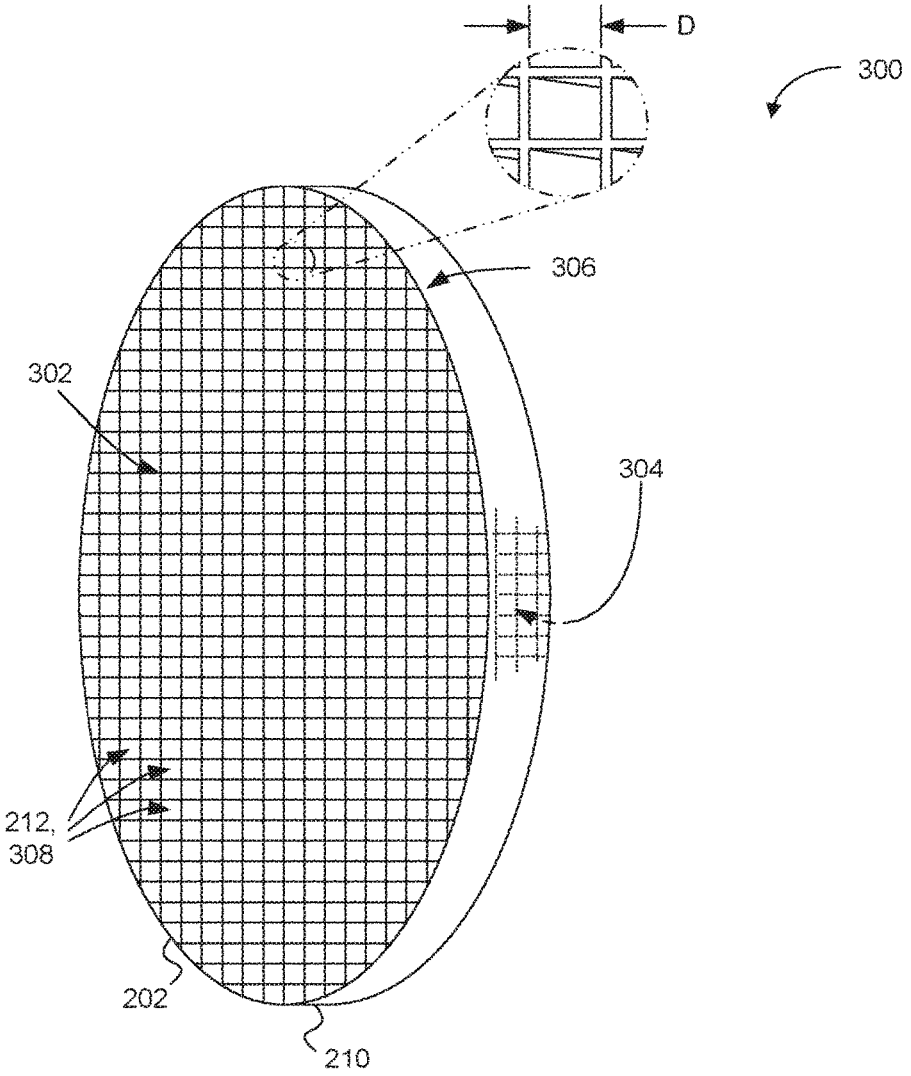
FIG. 3 is a view of a perforated flame holder of FIG. 2, according to an embodiment.

FIG. 3 is a view 300 of the perforated flame holder 202 of FIG. 2, according to an embodiment. The perforated flame holder 202 includes a body 210 that defines a plurality of void volumes 212 operable to receive and convey fuel and air, to hold a combustion reaction supported by the fuel and air, and to convey and output combustion reaction products. The body 210 is also configured to receive heat from the combustion reaction 204 in the void volumes 212, hold the heat, and output the heat to the fuel and air in the void volumes 212. The exchange of heat to and from the perforated flame holder 202 maintains combustion of a lean fuel and air mixture. The exchange of heat can maintain stable combustion of a mixture that would be susceptible to blow out otherwise.

The body 210 defines an input surface 302 configured to receive the fuel and air, an output surface 304 opposite to the input surface 302, and a peripheral surface 306 defining a lateral extent of the perforated flame holder 202. In some embodiments, the void volumes 212 include a plurality of elongated apertures 308 extending from the input surface 302 to the output surface 304 through the perforated flame holder 202. The void volumes 212 and the plurality of elongated apertures 308 are configured to hold the combustion reaction 204 substantially between the input surface 302 and the output surface 304 of the perforated flame holder 202. In some embodiments, the elongated apertures 308 can each have a lateral dimension D greater than a quenching distance of the fuel in the fuel jet 206. This is described more fully below.

Holding the combustion reaction 204 substantially between the input surface 302 and output surface 304 of the perforated flame holder 202 means that, under steady state conditions, a majority of the combustion reaction 204 occurs between the input surface 302 and the output surface 304. Variability in combustion reaction 204 holding location can be visualized with reference to FIG. 6.

Figure 4:
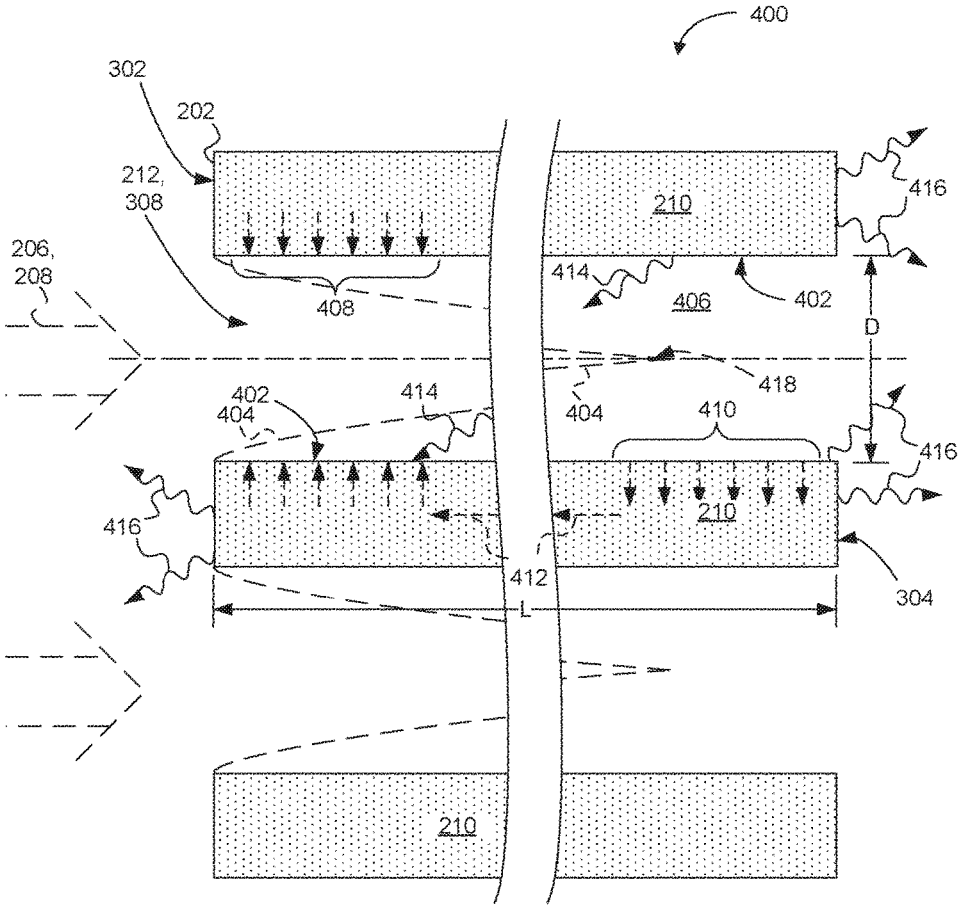
FIG. 4 is a side-sectional view of a portion of the perforated flame holder of FIGS. 2 and 3, according to an embodiment.
Figure 5:
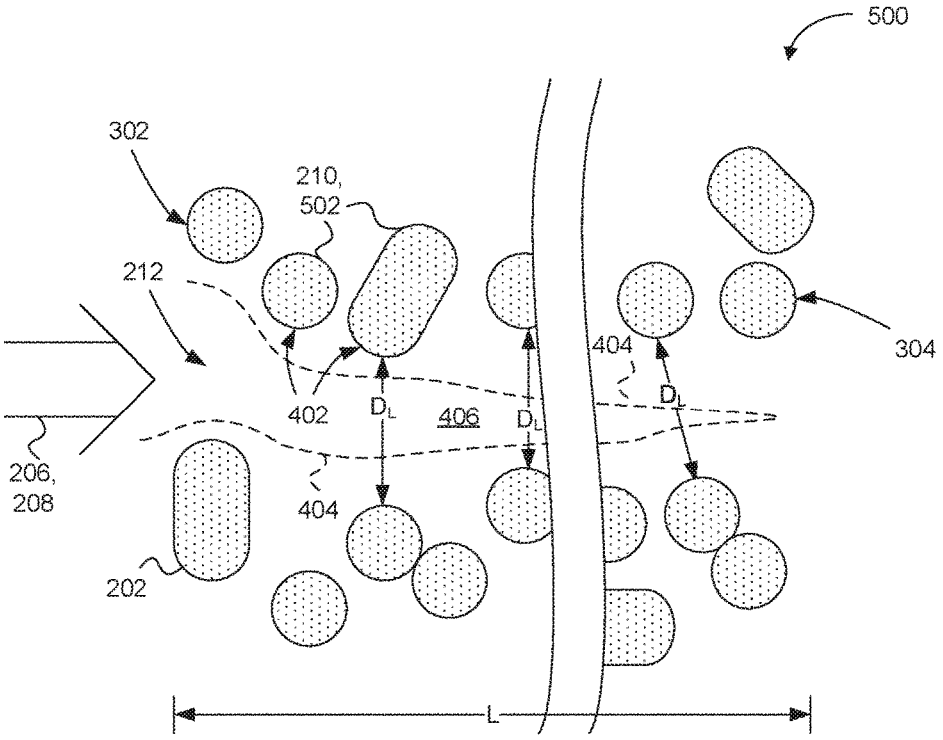
FIG. 5 is a sectional view of an alternative form of perforated flame holder wherein the perforated flame holder body is formed from reticulated fibers, according to an embodiment.
Figure 6:
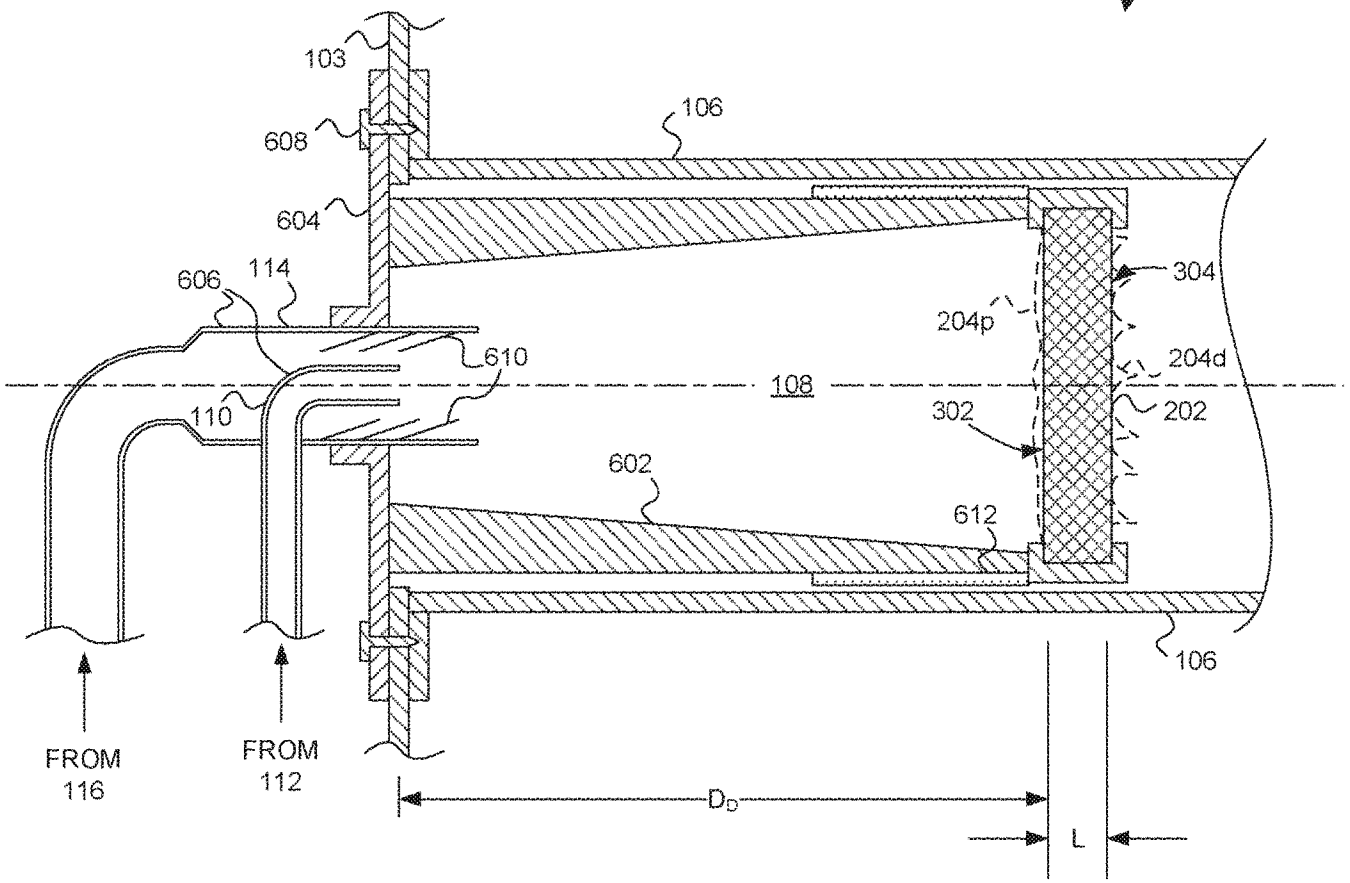
FIG. 6 is a side sectional view of a portion of a boiler including an apparatus for supporting a perforated flame holder within a combustion pipe, according to an embodiment.
Figure 7:
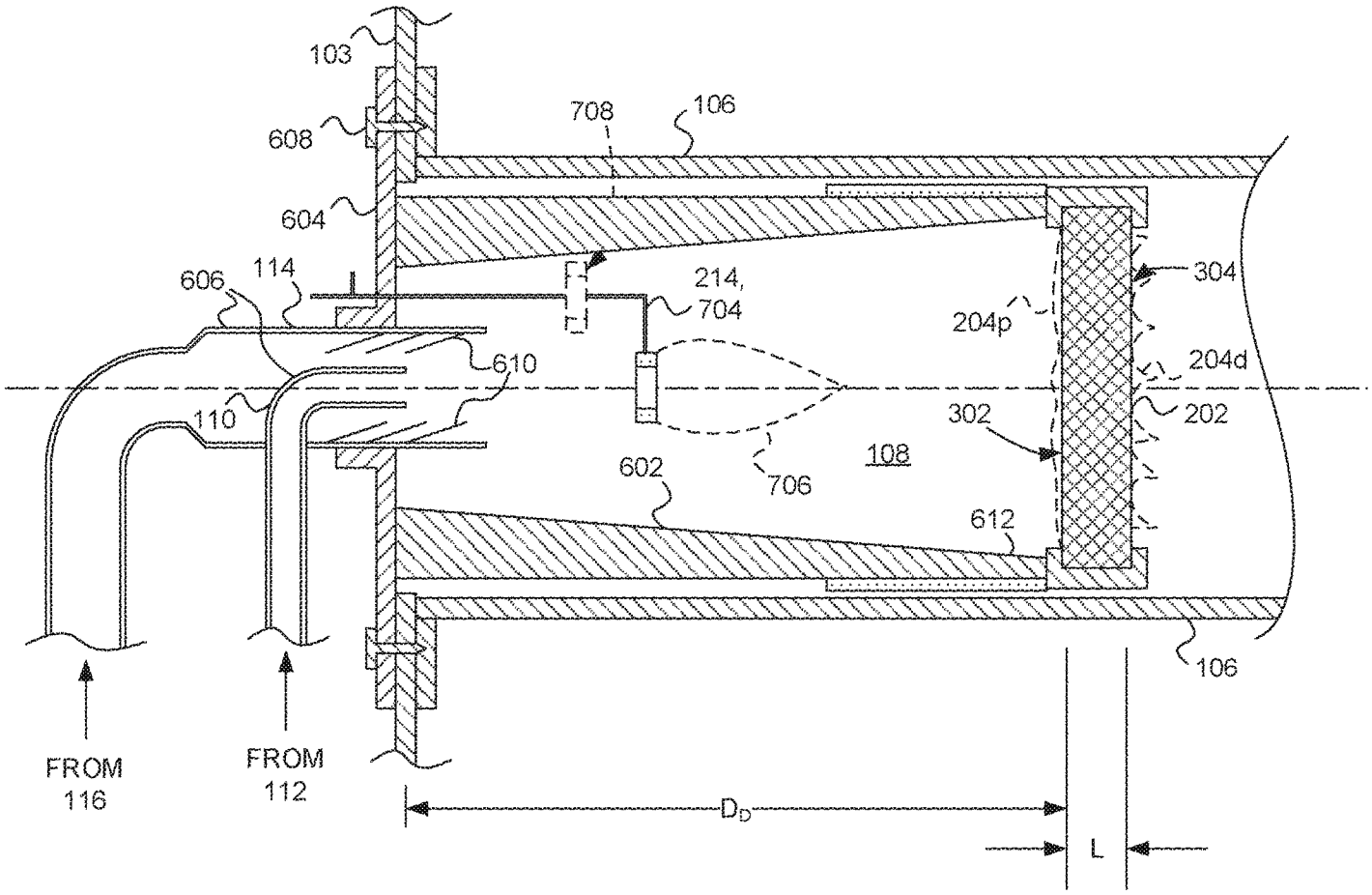
FIG. 7 is a diagram of a portion of a boiler with a start up apparatus including a proximal flame holder configured to hold a start-up flame to pre-heat the perforated flame holder, according to an embodiment.

In some cases, a portion of the combustion reaction 204 can extend outside the length L (as shown in FIGS. 4-7) corresponding to a combustion distance between the input and output surfaces 302, 304 of the perforated flame holder 202. In some cases, particularly at relatively low fuel and air flow rates, a proximal extension of the combustion reaction 204*p* (as shown in FIGS. 6 and 7) can be seen just upstream from the input surface 302 of the perforated flame holder 202. The proximal combustion extension 204*p* extends from the input surface 302 less than the combustion path length L within the perforated flame holder 202 and is believed to be caused by a combination of a small amount of flow stagnation at the leading edge of walls around the void volumes 212 (e.g., elongated apertures 308) combined with heat conduction from the hot perforated flame holder 202. In some cases, particularly at relatively high fuel and air flow rates, a distal extension of the combustion reaction 204*d* (as shown in FIGS. 6 and 7) can be seen just downstream from the output surface 304 of the perforated flame holder 202. The downstream extension 204*d* may be caused by the combustion reaction being completed after exiting the perforated flame holder 202, or the downstream extension 204*d* may be the result of plasma particles returning to ground state, with combustion having being substantially completed within the perforated flame holder 202. Generally, the distal extension 204*d* of the combustion reaction is less than L in distance from the output surface 304 of the perforated flame holder 202. Transient conditions (e.g., interruptions or surges in air or fuel flow) can intermittently cause greater extension of what is apparently the combustion reaction 204. Holding the combustion reaction 204 substantially between the input surface 302 and output surface 304 of the perforated flame holder 202 refers to steady state operating conditions.

The perforated flame holder 202 can be disposed substantially adjacent to the combustion pipe 106 around its entire perimeter 210. Additionally or alternatively, the perforated flame holder 202 can be disposed at least partly separated from the combustion pipe 106 such that natural flue gas recirculation can occur.

FIG. 4 is a side-sectional view 400 of a portion of the perforated flame holder 202 of FIGS. 2 and 3, according to an embodiment. The view 400 shows two portions of the body 210, each portion having walls 402 that define respective void volumes 212 having length L and lateral dimension D. Input and output surfaces 302, 304 of the perforated flame holder 202 are defined by respective ends of the body portions 210. The sectional view 400 illustrates a section taken through a void volume 212. In one example the void volume 212 is an elongated aperture 308. In the depicted elongated aperture embodiment 400, the body sections 210 are substantially contiguous in that they form a continuous perimeter around each elongated aperture 308. In one embodiment, the continuous perimeter defines a circular elongated aperture 308. In another embodiment, the continuous perimeter defines a square elongated aperture. In another embodiment, the continuous perimeter defines a hexagonal elongated aperture. A perforated flame holder 202 having square or hexagonal elongated apertures 308 is referred to as a honeycomb. In another embodiment, the void volume 212 can form a slot, such as a linear slot or a circular slot. In another embodiment, an elongated aperture can be L-shaped or otherwise irregular in shape. In embodiments using uniform cross-section elongated apertures where the elongated aperture 308 has different lateral dimensions depending on angle, the dimension D refers to the smallest lateral dimension between opposing elongated aperture walls 402. For embodiments using non-uniform cross section elongated apertures, or which use void volumes other than elongated apertures, the dimension D can be approximated by a root-mean-square (square root of the mean of squares of a statistically significant sample of local lateral dimensions $D_L$ along the length L).

The body 210 can include a refractory material. The refractory material can include at least one of cordierite or mullite. The body 210 can define a honeycomb, for example. Honeycomb shapes used in the perforated flame holder 202 can be formed from VERSAGRID® ceramic honeycomb, available from Applied Ceramics, Inc. of Doraville, S.C.

Alternative arrangements of the elongated apertures 308 are contemplated by the inventors. For example, the elongated apertures 308 can be formed as circular holes that penetrate through the perforated flame holder body 210. Examples of hole size and placement are provided in PCT Patent Application No. PCT/US2014/016626, filed on Feb. 14, 2014, entitled "SELECTABLE DILUTION LOW $NO_X$ BURNER; PCT Patent Application No. PCT/US2014/016628, filed on Feb. 14, 2014, entitled "PERFORATED FLAME HOLDER AND BURNER INCLUDING A PERFORATED FLAME HOLDER"; PCT Patent Application No. PCT/US2014/016632, entitled "FUEL COMBUSTION SYSTEM WITH A PERFORATED REACTION HOLDER", filed Feb. 14, 2014; and PCT Patent Application No. PCT/US2014/016622, entitled "STARTUP METHOD AND MECHANISM FOR A BURNER HAVING A PERFORATED FLAME HOLDER", filed Feb. 14, 2014; each of which is incorporated by reference herein. In one particular embodiment, the perforated flame holder 202 includes a body 210 defining a central aperture, a first set of apertures in a concentric arrangement relative to the central aperture having a selected spacing and size, and a second set of apertures in concentric arrangement relative to the central aperture having a different selected spacing and size. Compared to earlier burner apparatuses, this perforated flame holder geometry is configured to hold the combustion reaction between the input surface 302 and output surface 304 of the perforated flame holder 202.

In another embodiment, the perforated flame holder 202 is formed from two or more adjacent bodies defining void volumes 212 such as two or more bodies defining elongated apertures 308. The adjacent bodies can be arranged for sequential flow of the fuel and air and/or combustion reaction 204 supported by the fuel and air. In some embodiments, the perforated flame holder 202 is formed in sections from side-by-side honeycomb sections.

In another embodiment, the perforated flame holder 202 is formed from one or more bodies defining elongated apertures 308 that include discontinuous walls, such that fuel and air, combustion reactions supported by the fuel and air, and/or flue gases produced by the combustion reactions can cross from one elongated aperture 308 to a neighboring elongated aperture 308 (either at one or multiple locations).

Mixed fuel 206 and air 208 can be delivered substantially completely mixed to the input surface 302 of the perforated flame holder 202. In another embodiment, the fuel and air are mixed to a time-averaged Gaussian mixture distribution such that at any instant, a single maximum exists. The position of the maximum can wander across the surface of the perforated flame holder 202 according to variations in the location of vortex cores that each represent substantially completely mixed packets of fuel and air. Preferably, the vortex cores are sufficiently mixed that Taylor Layers between subsequent vortices are absorbed by the vortex cores.

The fuel and air stream, which may be continuous upstream from the perforated flame holder 202, is divided into portions as it enters the elongated apertures 308, the flow being split by the input surface 302 of the body portions 210 defining respective elongated apertures 308. Each elongated aperture 308 may be regarded as receiving one portion of the fuel and air 206, 208. The plurality of void volumes 212 can hold respective portions of the combustion reaction 204. The fuel and air portion, a combustion reaction 204 portion supported by the fuel and air, and a flue gas portion produced by the combustion reaction 204 portion in the elongated aperture 308, may be referred to as combustion fluid 406.

Thermal boundary layers 404 are formed in the combustion fluid 406 along the walls 402 of the elongated apertures 308. The boundary layers 404 transfer heat from the body 210 to the combustion fluid 406 and from the combustion fluid 406 to the body 210. Net transfer of heat is generally from the body 210 to the combustion fluid 406 in a first region 408 of the elongated aperture wall 402 near the input surface 302. This results in heating and an increase in temperature of the combustion fluid 406 sufficient to cause and maintain ignition of the fuel and oxidant. The particular length of the first region 408 can vary according to operating conditions of the fire tube boiler 200. For example, if the incoming fuel and air 206, 208 are particularly cold or if the perforated flame holder body 210 is cooler than normal, then the first region 408 can be a little longer than normal. Conversely, if the incoming fuel and air 206, 208 are warmer than normal or if the perforated flame holder body 210 is hotter than normal, then the first region 408 can be a little shorter than normal.

In a second region 410 of the elongated aperture 308 near the output surface 304 of the elongated aperture wall 402, net transfer of heat is generally from the combustion fluid 406 to the flame holder body 210. The source of heat in the combustion fluid 406 is the exothermic combustion reaction. The transfer of heat from the combustion fluid 406 to the body 210 results in cooling of the combustion reaction 204. Cooling of the combustion reaction 204 tends to reduce peak combustion temperature, which reduces production of thermal NOx.

There is a net transfer of heat from the second region 410 to the first region 408 of the body 210 adjacent to the elongated aperture 308 whereby heat released by the exothermic combustion reaction is recycled upstream to heat the incoming fuel and air 206, 208. Two heat transfer mechanisms are contemplated by the inventors. Heat conduction or other transfer mechanism (indicated by dashed arrows 412) within the body portions 210 can move heat countercurrent to the combustion fluid flow. As an alternative, the body 210 can define a working fluid volume, and the working fluid can aid in transferring heat from the second region 410 to the first region 408 of the body 210 adjacent to the elongated aperture 308. A co-pending patent application, PCT Patent Application No. PCT/US2014/062291, filed on Oct. 24, 2014, entitled "SYSTEM AND COMBUSTION REACTION HOLDER CONFIGURED TO TRANSFER HEAT FROM A COMBUSTION REACTION TO A FLUID", describes the alternative of the body defining a working fluid volume, and is incorporated by reference herein. In systems where the perforated flame holder body 210 defines a working fluid volume, the working fluid can further transfer heat to the boiler water 104 (see FIG. 2, for example), or the working fluid can consist essentially of boiler water 104 that circulates between the working fluid volume and the larger boiler water volume.

Another contemplated heat transfer mechanism uses radiation heat transfer. In the radiation heat transfer mechanism, thermal radiation 416 (indicated by rays 414) is emitted from the wall 402 of the hotter second region 410 toward the wall 402 of the cooler first region 408 adjacent to the elongated aperture 308.

Referring to FIGS. 2 and 4, thermal radiation 416 is also output from the perforated flame holder 202 to the combustion pipe wall. The combustion fluid 406 exiting the output surface 304 of the perforated flame holder 202 carries additional heat away for conductive or convective transfer to the combustion pipe 106 and the tubes 120, 122 of the boiler 200, and therethrough to the boiler water 104.

Referring again to FIG. 4, the elongated apertures 308 each have a length L sufficient for thermal boundary layers 404 formed along the walls 402 defining the elongated apertures 308 to substantially merge.

An idealized point of merger 418 is shown where boundary layers 404 from opposing walls 402 meet substantially at a centerline of the elongated aperture 308. In practice, the point of merger 418 can be somewhat upstream of the output surface 304 adjacent to the elongated aperture 308, or can be somewhat downstream of the output surface 304. Ideally, the point of merger 418 is sufficiently upstream of the output surface 304 to allow a chemical ignition delay time to elapse just as an infinitesimal volume of combustion fluid 406 exits the elongated aperture 308 at the output surface 304. This arrangement results in cooling of the entire combustion reaction 204 by the flame holder body 210, while also minimizing residence time at the combustion temperature. In practice, the point of merger 418 may vary slightly. A point of merger 418 estimated to be somewhat upstream from the output surface 304 was found to result in substantially no measurable NOx (<0.5 parts per million (PPM)) to very low single digit NOx (<2-3 PPM) in experimental runs. A point of merger 418 downstream from the output surface 304 runs a risk of fuel slip and/or excessive carbon monoxide (CO) output. Another problem with points of merger downstream from the output surface is the combustion reaction stability is negatively affected because a significant portion of the fuel and air may not be heated to a sufficiently high temperature to maintain ignition.

The body 210 defining the perforated flame holder 202 can be configured to receive heat from the combustion reaction 204 at least in the second regions 410 of elongated apertures 308 forming the void volumes 212 near an output surface 304 of the perforated flame holder 202. The body 210 can be configured to output heat to the fuel and air at least in a region 408 near an input surface 302 adjacent to the void volume 212.

Additionally or alternatively, the body 210 can be configured to receive heat from the combustion reaction 204 and output radiated heat energy 416 to maintain a temperature of the body 210 below an adiabatic flame temperature of the combustion reaction 204. In another embodiment, the body 210 can be configured to receive heat from the combustion reaction 204 to cool the combustion reaction 204 to a temperature below an adiabatic flame temperature of the combustion reaction 204. In another embodiment, the body 210 can be configured to receive heat from the combustion reaction 204 to cool the combustion reaction 204 to a temperature below a NOx formation temperature.

The body 210 can be configured to receive heat from the combustion reaction 204 and to emit thermal radiation 416 toward a region 408 of the body 210 defining a void volume wall 402 that is cooled by incoming fuel and air flow. The received thermal radiation 416 can maintain a temperature of the region 408 of the body 210 that is cooled by incoming fuel and air flow. The heat carried by the region 408 of the body 210 can be conducted to the incoming fuel and air 206, 208 flow to raise the temperature of the fuel and air to maintain combustion. Additionally or alternatively, the body 210 can be configured to conduct heat toward the region 408 of the body 210 that is cooled by incoming fuel and air 206, 208 flow.

The walls 402 of the body 210 can transfer heat to incoming fuel and air 206, 208 by conducting heat to thermal boundary layers 404 formed adjacent to the walls 402 defining the void volumes 212. The boundary layers 404 can increase in thickness sufficient to heat substantially the entirety of fuel and air 206, 208 passing through the void volumes 212.

A number of aspects distinguish the perforated flame holder 202 over earlier burner apparatuses. In one aspect, the thermal boundary layer thickness at any given location varies with fuel and air velocity such that the combustion front can freely move upstream and downstream responsive to a decrease or increase in flow velocity, respectively. In this respect, the perforated flame holder will not prevent propagation of a flame upstream across a range of operating temperatures.

One simplified way of looking at this is to compare the dimension D to a fuel characteristic known as "quenching distance". Before entering a description of fuel quenching distance, it should be noted that perforated flame holders that have lateral dimensions less than published quenching distances have been successfully tested by the inventors. On the other hand, earlier apparatuses that operate using different principles typically require that any porosity in the flame holder be limited to sizes less than quenching distance in order to avoid potentially explosive travel of the combustion reaction into a fuel and air mixture volume that can undergo conflagration or detonation. The inventors have found that, in embodiments described herein, lateral dimensions D greater than the flame quenching distance can be useful for allowing longer thickness L (having greater mechanical stability) and also for reducing flow back pressure.

In some embodiments, the plurality of elongated apertures 308 can be each characterized by a lateral dimension D equal to or greater than a flame quenching distance.

The quenching distance is evaluated under stoichiometric conditions. It is generally considered a property of the fuel and exists as a tabulated property. Most hydrocarbons have quenching distances of about 0.1". For example, NACA Lewis Report 1300 tabulates quenching distance as shown in Table 1.

The quenching distance represents the diameter of an orifice such that a stoichiometrically premixed flame cannot propagate upstream through the orifice into a premix reservoir. The mechanism is essentially one of heat abstraction—the flame giving up too much energy as it attempts to flashback through the orifice. Since this is a thermal argument, actual flashback can occur through the quenching distance if the orifice is very hot—for example, if a premixed burner reservoir is receiving radiant heat from a hot furnace, e.g., a premix burner in ethylene service. But even so, in general the quenching distance does not change dramatically inasmuch as the flow of premixed fuel and air tend to cool the orifice.

In contrast to perforated flame holders 202 described herein, radiant burners that support surface combustion must have a minimum pore size less than the quenching distance for the particular fuel and temperature to avoid flashback, and it could be considered a tautology that if the flame flashes back, the pore size must be greater than the actual quenching distance under the operating conditions.

Quenching distances for several fuels under standard conditions are tabulated in Table 1, below.

TABLE 1

FUEL QUENCHING DISTANCES

| HYDROCARBON FUEL | QUENCHING DISTANCE |
|---|---|
| n-Butane | 0.12" |
| Methane | 0.10" |
| Propane | 0.08" |
| Hydrogen | 0.025" |

The inventors found that for a given flow velocity, a larger dimension D in an elongated aperture (also referred to as a coarser mesh of a honeycomb flame holder) requires a larger length L of the elongated aperture (also referred to as a thicker mesh layer) in to reach the lowest NOx production. For tested combinations, the length L was equal to the distance between the input surface 302 and output surface 304 (also referred to as thickness) of the perforated flame holder 202. Similarly, smaller D was found to operate effectively with a smaller elongated aperture length L.

The void volume 212 can be characterized by a void fraction, expressed as (total perforated flame holder 202 volume−body 210 volume)/total perforated flame holder 202 volume) can vary. Increasing the void fraction can decrease flow resistance of combustion fluids through the perforated flame holder 202; however increasing the void fraction too much can make the perforated flame holder 202 more fragile and/or can reduce the heat capacity of the flame holder body 210 to reduce its effectiveness in maintaining combustion. In honeycomb perforated flame holders tested by the inventors, the void fraction was about 70% (0.70), which is believed to be a good nominal value. In other experiments, a void fraction as low as 10% was used and found to be effective. A lower void fraction (e.g., 10%) can be especially advantageous when the perforated flame holder 202 is formed from a relatively fragile material.

FIG. 5 is a sectional view of an alternative form 500 of perforated flame holder 202, wherein the perforated flame holder body 210 is formed from reticulated fibers 502, according to an embodiment. The reticulated fibers 502 define the void volumes 212. In reticulated fiber embodiments, the interaction between flow of fuel, air, and supported combustion reaction 204 portions and heat received and provided from the reticulated fibers 502 functions similarly to elongated aperture operation, as described herein. Compared to prior art "surface combustion" approaches, the reticulated fiber form 500 of the perforated flame holder 202 include void volumes 212 characterized by lateral dimensions D equal to or greater than a flame quenching distance, described above. In addition to offering reduced flow constriction, a reticulated fiber perforated flame holder 500, 202 disclosed herein is not prone to failure if the reticulated fibers 502 tear or otherwise open up passages having lateral dimension D equal to or greater than the flame quenching distance. To the contrary, according to embodiments, the reticulated fiber perforated flame holder 500, 202 described herein is intended to operate with perforations having lateral dimension D equal to or greater than the flame quenching distance.

The reticulated fibers 502 can include a reticulated network of ceramic fibers. In some embodiments, the body 210 includes reticulated metal fibers. In either case, it is desirable for the reticulated fiber network to be sufficiently open for downstream fibers to emit radiation for receipt by upstream fibers for the purpose of heating the upstream fibers sufficiently to maintain combustion of a lean fuel and air mixture.

In embodiments including arrangements other than continuous elongated apertures 308, the formation of boundary layers 404, transfer of heat between the body 210 and the combustion fluid 406 flowing through the void volumes 212, characteristic dimension D, and length L can be regarded as related to an average or overall path through the perforated flame holder 202. In other words, the dimension D can be determined as a mathematical average of individual $D_n$ values determined at each point along a flow path. Similarly, the length L can be a length that includes length contributed by tortuosity of the flow path, which may be somewhat shorter than a straight line distance L from the input surface 302 to the output surface 304 through the perforated flame holder 202. According to an embodiment, the void fraction (expressed as (total perforated flame holder 202 volume–fiber 210 volume)/total 202 volume)) is about 70%.

FIG. 6 is a side sectional view 600 of a portion of a boiler including an apparatus 602 for supporting a perforated flame holder 202 within a combustion pipe 106, according to an embodiment. The fuel nozzle 110 can be characterized by a nozzle diameter through which fuel is emitted. A flame holder support structure 602 is operatively coupled to the perforated flame holder 202 and configured to hold the perforated flame holder 202 at a dilution distance ($D_D$) from the fuel nozzle 110. According to an embodiment, the dilution distance can be at least 20 nozzle diameters. According to another embodiment the dilution distance can be 100 nozzle diameters or more. In another embodiment, the dilution distance can be 245 nozzle diameters or more. In another embodiment, the dilution distance can be about 265 nozzle diameters. The effect of dilution distance $D_D$ can be seen by inspection of FIG. 10.

The shell 102 (as shown in FIGS. 1 and 2) can include a front wall 103 peripheral to the combustion pipe 106. A flange 604 can be included and operatively coupled to the front wall 103. The flame holder support structure 602 can be operatively coupled to the flange 604. The flange 604, the support structure 602, and the perforated flame holder 202 can be configured to be installed in the combustion pipe 106 as a unit without a mechanical coupling to the combustion pipe 106.

The fuel nozzle 110 and the air source 114 together can comprise a fuel nozzle assembly 606. The fuel nozzle assembly 606 can be operatively coupled to the flange 604. The flange 604, the fuel nozzle assembly 606, the support structure 602, and the perforated flame holder 202 can be configured to be installed relative to the combustion pipe 106 as a unit without a mechanical coupling to the combustion pipe 106. The flange 604, the fuel nozzle assembly 606, the support structure 602 and the perforated flame holder 202 can be configured to be retrofitted to the boiler 200. The flange 604, the fuel nozzle assembly 606, the support structure 602 and the perforated flame holder 202 can be configured to be installed in and uninstalled from the boiler 200 as a unit for purposes of changing the porous flame holder 202. The flange 604 can be coupled to the front wall 103 of the shell 102 using threaded fasteners 608, for example.

Typically, in the prior art, a fuel nozzle assembly 606 includes swirl vanes 610 or equivalent structures (such as a bluff body, for example) aligned to cause vortices to form near to the fuel nozzle assembly 606. The vortices operate to recycle heat released by a conventional flame 118 back to incoming fuel and air 206, 208 to cause the flame 118 to be maintained near the fuel nozzle assembly 606. Visible edges of the flame typically correspond to the hottest temperatures in the flame 118 and account for a majority of thermal NOx production.

According to embodiments, part of the function of the perforated flame holder 202 is to hold a combustion reaction 204 away from the fuel nozzle assembly 606 and to substantially prevent visible edges of the flame 118 to exist. In a sense, the perforated flame holder 202 supports flameless combustion 204.

According to an embodiment, the swirl vanes 610 can be aligned to prevent the flame 118 from being held proximate to the fuel nozzle assembly 606.

The support structure 602 can be configured to hold the perforated flame holder 202 away from the fuel nozzle 110 at a distance sufficient to cause substantially complete mixing of the fuel and air at a location where the fuel and air impinge upon the perforated flame holder 202. Thermal insulation 612 can be included and operatively coupled to the flame holder support structure 602. The thermal insulation 612 can be supported by the support structure 602 adjacent to the wall of the combustion pipe 106 along at least a portion of the distance ($D_D$) between the fuel nozzle 110 and the perforated flame holder 202. In some embodiments, the thermal insulation 612 can be affixed to the combustion pipe 106 wall. Additionally or alternatively, thermal insulation 612 can be disposed adjacent to the wall of the combustion pipe 106 along at least a portion of the distance ($D_D$) between the fuel nozzle 110 and the perforated flame holder 202. For example, the thermal insulation 612 can be formed from a 1 inch thick FIBERFRAX © DURABLANKET © high temperature insulating blanket, available from UNIFRAX I LLC of Niagara Falls, N.Y.

The shell 102 can include the front wall 103 peripheral to the combustion pipe 106. The flange 604 can be further included and operatively coupled to the front wall 103. The flame holder support structure 602 can be operatively coupled to the flange 604. The fuel nozzle 110 and the air source 114 together can comprise the fuel nozzle assembly 606. The flange 604 can be configured to hold the fuel nozzle assembly 606 away from the front wall 103 of the boiler 200 such that the fuel nozzle assembly 606 is configured to output at least partially mixed fuel and air past a plane coincident with the front wall 103 of the boiler 200.

In other words, the entire assemblage including the fuel nozzle assembly 606, the flame holder support structure 602, and the perforated flame holder 202 can be disposed to the left relative to the boiler shell 102 and the combustion pipe 106 such that a portion of the dilution distance $D_D$ extends outside of the boiler shell 102 to the left of the front wall 103. This alignment can be useful in applications where the combustion pipe 106 length would place the perforated flame holder 202 closer to an output end of the combustion pipe 106 than is desirable.

Figure 8:
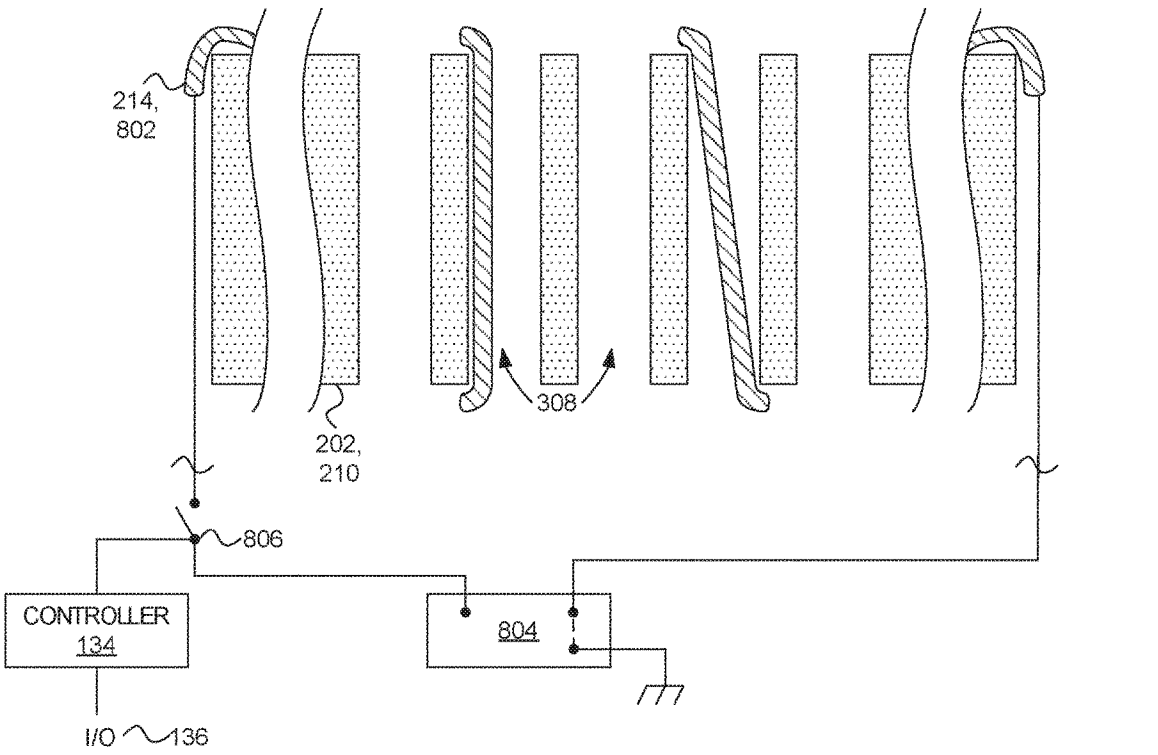
FIG. 8 is a sectional view of a portion of a boiler with a start-up apparatus including a perforated flame holder electrical resistance heater configured to pre-heat the perforated flame holder, combined with a block diagram of system elements operatively coupled to the electrical resistance heater, according to another embodiment.

FIG. 7 is a diagram of a portion of a boiler 700 with a start up apparatus 214 including a proximal flame holder 704 configured to hold a start-up flame 706 to pre-heat the perforated flame holder 202, according to an embodiment. FIG. 8 is a diagram of a portion of a boiler 800 with a start-up apparatus 214 including a perforated flame holder electrical resistance heater 802 configured to pre-heat the perforated flame holder 202, according to another embodiment. The start-up apparatus 214 can be configured to pre-heat the perforated flame holder 202 prior to supporting the combustion reaction 204 with the perforated flame holder 202.

As described above, the perforated flame holder 202 is understood to operate at least partly by receiving heat from the individual portions of the combustion reaction 204 held inside the portions of the void volume 212, 308, and outputting the received heat to a relatively cool incoming fuel/air mixture. If the perforated flame holder 202 is not hot enough to cause autoignition of the fuel air mixture, the perforated flame holder 202 will not operate as described. According to embodiments, provision is made for pre-heating the perforated flame holder 202 prior to introducing the fuel and air flow to the perforated flame holder 202 for combustion therein. Various approaches to pre-heating the perforated flame holder 202 are contemplated by the inventors.

Referring to FIG. 7, the start-up apparatus 214 can include a start-up flame holder 704 configured to temporarily hold a start-up flame 706 disposed to output heat to the perforated flame holder 202. The start-up flame holder 704 can include a bluff body configured to cause vortices to circulate heat to maintain the start-up flame 706.

The start-up flame holder 704 can be configured to be mechanically retracted to a position 708 that does not hold the start-up flame 706 after the perforated flame holder 202 has reached an operating temperature. The start-up flame holder 704 can be configured for manual actuation by a boiler operator. Additionally or alternatively, the start-up flame holder 704 can include an actuator configured to actuate the position of the bluff body responsive to receiving a signal from an electronic controller (see, e.g., FIG. 2).

The start-up apparatus 214 can further include a flame charger disposed to output charges to the start-up flame 706. The start-up apparatus 214 can include a conductive body configured to attract the charges from the start-up flame 706 to hold the start-up flame 706 for outputting heat to the perforated flame holder 202. Additionally or alternatively, the conductive body can be configured to form an electric field with the charges in the start-up flame 706 to hold the start-up flame 706 for outputting heat to the perforated flame holder 202.

In another embodiment, the start-up apparatus 214 can include a position actuator operatively coupled to the perforated flame holder 202. During start-up, the position actuator positions the perforated flame holder 202 in a proximal position relatively near the fuel nozzle assembly 606. The proximal location corresponds to a relatively rich fuel and air mixture that will support a stable flame without the heat exchange function described in conjunction with FIGS. 4 and 5. After the (relatively rich mixture) start-up combustion reaction is ignited, heat from the combustion reaction increases the temperature of the perforated flame holder 202. The position actuator then moves the perforated flame holder 202 to a distal location illustrated in FIGS. 2, 6, and 7, where the heated perforated flame holder maintains a stable combustion reaction using a relatively lean fuel and air mixture that produces reduced [NOx], according to the mechanisms described in conjunction with FIGS. 4 and 5.

FIG. 8 is a side sectional diagram 800 of a perforated flame holder 202 equipped with a start-up apparatus 214 including an electrical resistance heater 802 configured to output heat to the perforated flame holder 202. The start-up apparatus 214 can further include a voltage source 804 operatively coupled to the electrical resistance heater 802. The controller 134 can be operatively coupled to a switch 806 configured to make or break contact between the voltage source and the electrical resistance heater 802. Upon receiving a start-up command via a data interface 136, the controller 134 causes the switch 806 to close for a period of time sufficient to heat the electrical resistance heater 802 and portions of the perforated flame holder 202 adjacent to the electrical resistance heater 802. The electrical resistance heater 802 can be formed in various ways. For example, the electrical resistance heater 802 can be formed from KANTHAL® wire (available from Sandvik Materials Technology division of Sandvik AB of Hallstahammar, Sweden) threaded through at least a portion of elongated apertures 308 formed by the perforated flame holder body 210. Alternatively, the heater 802 can include an inductive heater, a high energy (e.g. microwave or laser) beam heater, a frictional heater, or other types of heating technologies.

In an embodiment using a 48 inch length of Kanthal wire threaded through the perforated flame holder 202, the controller can cause a voltage source 804 outputting 90 VAC into electrical continuity with the electrical resistance heater 802 for about 90 seconds. After 90 seconds, the controller 134 can open a fuel valve and start a fan to deliver an air and fuel mixture to the perforated flame holder 202. After ignition of the fuel and air in the perforated flame holder 202, for example after about 95 seconds, the controller 134 opens the switch 806 to stop outputting heat with the electrical resistance heater 802, and the combustion reaction 204 is maintained by the mechanisms described in conjunction with FIG. 4. As the perforated flame holder 202 heats up, the controller 134 then increases fuel and air flow to output a desired heat delivery value.

For embodiments using shorter lengths of Kanthal wire, heating voltage and/or heating time can be reduced. For embodiments using longer lengths of Kanthal wire, voltage and/or time can be increased above 90 V and 90 seconds.

The start-up apparatus 214 can include an electrical discharge igniter configured to output a pulsed ignition to the air and fuel. Additionally or alternatively, the start-up apparatus can include a pilot flame apparatus disposed to ignite a fuel and air mixture entering the perforated flame holder 202. The electrical discharge igniter and/or pilot flame apparatus can be operatively coupled to an electronic controller (see, e.g., FIG. 2) configured to cause the electrical discharge igniter or pilot flame apparatus to maintain combustion of the air and fuel mixture in the perforated flame holder 202 before the perforated flame holder is heated sufficiently to maintain combustion.

Figure 9:
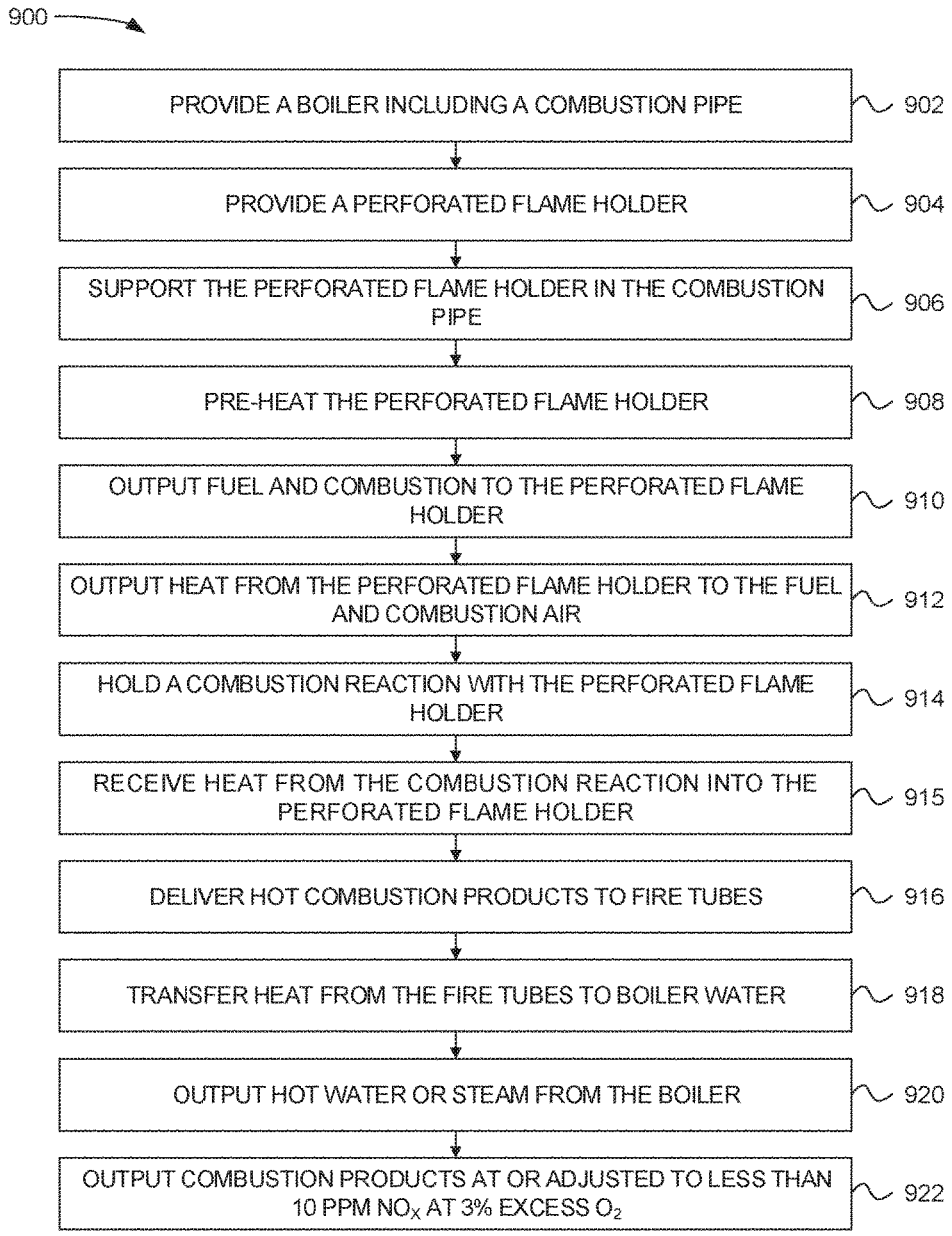
FIG. 9 is a flow chart showing a method of operating a low NOx fire tube boiler, according to an embodiment.

FIG. 9 is a flow chart showing a method 900 for operating a low oxides of nitrogen (NOx) fire tube boiler, according to an embodiment. Description of FIG. 9 is made in view of FIGS. 2-8. In step 902 a fire tube boiler is provided. The fire tube boiler includes a boiler shell with least one combustion pipe disposed at least partially inside the shell and a plurality of fire tubes disposed inside the shell. The plurality of fire tubes are configured to receive combustion products from the combustion pipe. The combustion pipe is characterized by a length and an inside diameter. The boiler shell is configured to hold boiler water. The combustion pipe surrounds a combustion volume and forms a continuous volume with the plurality of fire tubes. The combustion pipe and fire tubes are configured to collectively hold the boiler water out of the combustion volume.

Proceeding to step 904, a perforated flame holder is provided. The perforate flame holder includes a body that defines a plurality of void volumes operable to convey the fuel and air and to hold a combustion reaction. In step 906, the perforated flame holder is supported in the combustion pipe.

Steps 908-922 describe operating the fire tube boiler that is provided in steps 902-906.

Beginning with step 908, the perforated flame holder is preheated. Step 908 is described in more detail below. Proceeding to step 910, fuel and combustion air are output into the combustion volume in a direction aligned to deliver mixed fuel and combustion air to the perforated flame holder. In step 912, heat is output from the perforated flame holder to the fuel and combustion air. In step 914, a combustion reaction supported by the fuel and combustion air is held with the perforated flame holder. In step 915, heat from the combustion reaction is received by the perforated flame holder. The loop of steps 912, 914, and 915 serve to keep the combustion reaction ignited. Some of the heat not needed to raise the temperature of the incoming fuel and air mixture (to or above the autoignition temperature of the fuel) is output as thermal radiation to the walls of the combustion pipe, and thereby to the boiler water to provide a portion of the boiler water heating. Some of the heat released by the combustion reaction is carried away by hot combustion products.

Proceeding to step 916, hot combustion products are delivered to the fire tubes via draft created by an exhaust flue. In step 918, heat is transferred from the fire tubes to the boiler water, and in step 920, hot water or steam is output from the boiler.

The operating characteristics of the perforated flame holder allow outputting combustion products including less than 10 parts per million NOx at 3% excess oxygen, in step 922. The inventors have achieved reliable output of combustion products including less than 5 parts per million NOx. In some experiments, the inventors achieved output of combustion products including less than 1 part per million NOx at 3% excess oxygen. It will be understood that outputting such low NOx at 3% excess oxygen is equivalent to outputting greater than 3% excess oxygen and adjusting a measured concentration of NOx. For example, if 6% excess oxygen and 5 parts per million NOx is measured in the flue, then the measured NOx output can be adjusted to an equivalent 10 parts per million at 3% excess oxygen.

Referring to operation of the perforated flame holder itself, in step 915, heat from the combustion reaction held in the void volumes is received into the body of the perforated flame holder. The received heat raises the temperature of the perforated flame holder body to a value at or above the autoignition temperature of the fuel. This allows the heat to be output to the incoming fuel and combustion air mixture at a temperature that maintains ignition. The received heat is held in the body of the perforated flame holder and transferred in an upstream direction toward an unburned portion of the fuel and combustion air mixture. The inventors contemplate two main heat transfer mechanisms. Part of the heat is likely transferred upstream via thermal radiation within the plurality of void volumes defined by the body of the perforated flame holder. Another part of the heat is likely transferred upstream via thermal conduction within the body of the perforated flame holder.

In any event, heat from the body of the perforated flame holder is output to the mixed fuel and combustion air in the void volumes to maintain combustion. According to an embodiment, the perforated flame holder body defines each of the plurality of void volumes as an elongated aperture. The inventors contemplate that outputting heat from the body of the perforated flame holder to the mixed fuel and combustion air in step 912 includes outputting heat into elongated apertures each having a length L sufficient for thermal boundary layers formed along walls defining the elongated apertures to substantially merge to cause the entirety of the fuel and combustion air to be heated to the autoignition temperature of the fuel in the fuel and combustion air mixture. This allows step 910 of outputting fuel and combustion air into the combustion volume in a direction aligned to deliver mixed fuel and combustion air to the perforated flame holder to deliver a leaner fuel mixture than what would stably burn in a stream-stabilized flame at a location corresponding to the perforated flame holder, while maintaining stable combustion.

In several embodiments, the perforated flame holder includes a body that defines a plurality of void volumes characterized by a void fraction, expressed as (total perforated flame holder volume−body volume)/total perforated flame holder volume, of about 70% (0.70).

The perforated flame holder can include a body made of a refractory material such as at least one of cordierite or mullite. As described above, the plurality of void volumes can be provided in a honeycomb arrangement.

Generally, the body of the perforated flame holder defines an input surface configured to receive the fuel and air, an output surface opposite to the input surface, and a peripheral surface defining a lateral extent of the perforated flame holder. The void volumes can include a plurality of elongated apertures extending from the input surface to the output surface of the perforated flame holder. Holding the combustion reaction with the perforated flame holder in step 914 can include holding at least a portion up to a majority of the combustion reaction to occur between the input surface and the output surface of the perforated flame holder. The inventors have observed conditions where no visible flame is present outside the perforated flame holder, yet combustion is complete. This may indicate that substantially all of the combustion reaction occurs between the input surface and output surface of the perforated flame holder, within the elongated apertures.

Holding the combustion reaction with the perforated flame holder can include holding the combustion reaction at least partially within the elongated apertures. Each elongated aperture can have a lateral dimension D equal to or greater than a quenching distance of the fuel in the mixed fuel and combustion air. In general, the inventors have found that it is not desirable to include a layer of porous material having pores smaller than the quenching distance.

Referring to step 906, supporting the perforated flame holder in the combustion pipe can include supporting the perforated flame holder adjacent to the combustion pipe around its entire perimeter. Alternatively, supporting the perforated flame holder in the combustion pipe can include supporting the perforated flame holder at least partly separated from the combustion pipe such that natural flue gas recirculation is allowed to occur (around the peripheral surface of the perforated flame holder).

Supporting the perforated flame holder in the combustion pipe can include supporting the perforated flame holder with a flame holder support structure away from the fuel nozzle at a distance sufficient to cause delivery of substantially completely mixed fuel and combustion air to the perforated flame holder. Step 906 can further include supporting thermal insulation adjacent to the wall of the combustion pipe along at least a portion of the distance between a fuel nozzle and the perforated flame holder.

Referring to step 910, outputting fuel and combustion air into the combustion volume in a direction aligned to deliver mixed fuel and combustion air to the perforated flame holder can include outputting a jet of fuel from a fuel nozzle and outputting combustion air from an air source disposed adjacent to the fuel nozzle. Outputting a jet of fuel from a fuel nozzle can include outputting a jet of a gaseous hydrocarbon fuel such as natural gas.

In an embodiment, outputting fuel and combustion air into the combustion volume in a direction aligned to deliver mixed fuel and combustion air to the perforated flame holder includes outputting fuel through a fuel nozzle characterized by a nozzle diameter through which the fuel is emitted, outputting combustion air adjacent to the emitted fuel, and allowing the fuel and combustion air to flow through a mixing distance before reaching the perforated flame holder. Step 906 can include supporting the perforated flame holder in the combustion pipe with a flame holder support structure at the mixing distance from the fuel nozzle. Generally, the mixing distance is at least 20 nozzle diameters. According to embodiments, the mixing distance is 100 nozzle diameters or more. In some embodiments, the mixing distance is 245 nozzle diameters or more. In particular, the mixing distance can be about 265 nozzle diameters.

As described above, the method 900 can include step 908, in which, before delivering mixed fuel and combustion air to the perforated flame holder, the perforated flame holder body is pre-heated to an operating temperature. Pre-heating the perforated flame holder to an operating temperature can include heating the perforated flame holder to a temperature at or above an autoignition temperature of mixed fuel and combustion air.

Various approaches for pre-heating the perforated flame holder have been developed by the inventors. In some embodiments, pre-heating the perforated flame holder to an operating temperature includes supporting a pre-heat flame upstream from the perforated flame holder. The pre-heat flame can be operated in several ways. For example, pre-heating the perforated flame holder to an operating temperature can include deploying a start-up flame holder to temporarily hold a start-up flame and outputting heat from the start-up flame to the perforated flame holder. The start-up flame holder can then be mechanically retracting to a position that does not hold the start-up flame after the perforated flame holder has reached an operating temperature. Mechanically retracting the start-up flame holder to a position that does not hold the start-up flame can include manually actuating the start-up flame holder or can include operating an actuator such as a stepper motor or a solenoid to retract the start-up flame holder. Alternatively, pre-heating the perforated flame holder to an operating temperature can further include outputting charges to a start-up flame with a flame charger and providing a conductive body configured to attract charges from the start-up flame to hold the start-up flame for outputting heat to the perforated flame holder.

In another embodiment, pre-heating the perforated flame holder to an operating temperature includes electrically heating the perforated flame holder.

Examples

Figure 10:
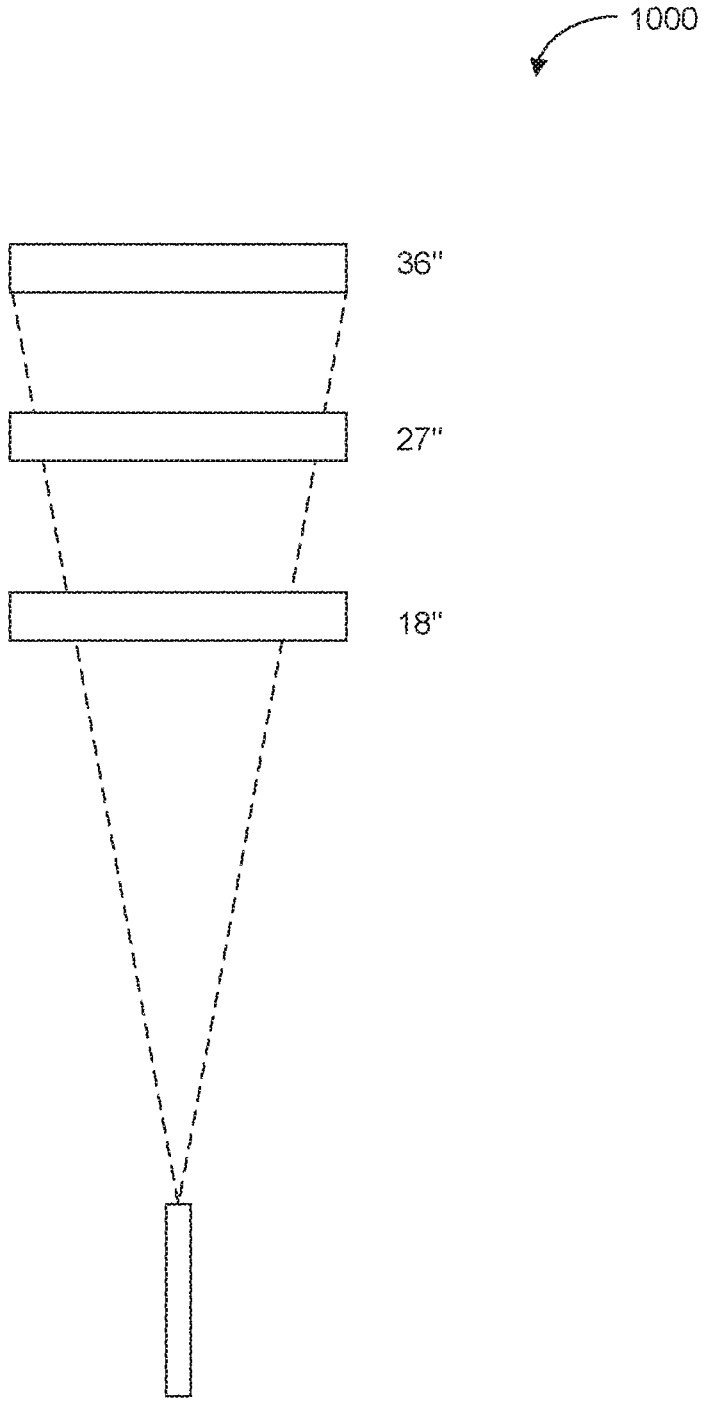
FIG. 10 is a diagram of an experimental apparatus used to determine the effect of dilution distance between a fuel nozzle and a perforated flame holder, according to an embodiment.

FIG. 10 is a diagram of an experimental apparatus 1000 used to determine the effect of dilution distance between a fuel nozzle and a perforated flame holder, according to an embodiment. In the experimental apparatus, test firings were conducted with the following conditions:

The fuel was methane.

Fuel pressure varied, but was about 12 psig throughout.

Fuel nozzle (pinhole) diameter was 0.11".

A damper in the exhaust flue was 'closed' with about a ¼" gap all the way around the damper. The stack size was about 12" square. The ¼" gap caused the exhaust flue damper to never completely close.

The air source (inlet air) was natural draft and was confined to a 3" hole arranged concentric to a fuel nozzle pipe that occluded about the center ¼" of the 3" hole.

NOx comparisons were made at 3% $O_2$ in the stack.

The perforated flame holder was 4" total thickness (L dimension). The 4" total thickness was formed as a 2" thick honeycomb bottom layer (VERSAGRID ceramic honeycomb, available from Applied Ceramics, Inc. of Doraville, S.C.) having 16 cells per square inch plus a 2" honeycomb (VERSAGRID) top layer having 64 cells per square inch.

Table 2 gives measured NOx output for each of three dilution distances.

TABLE 2

NOx Output as a Function of Dilution Distance

| PFH Height | Fuel/Air Velocity | NOx Result |
|---|---|---|
| 18" | 19 ft/sec | 14 ppm |
| 27" | 15 ft/sec | 2 ppm |
| 36" | 12 ft/sec | 6 ppm |

Figure 11:
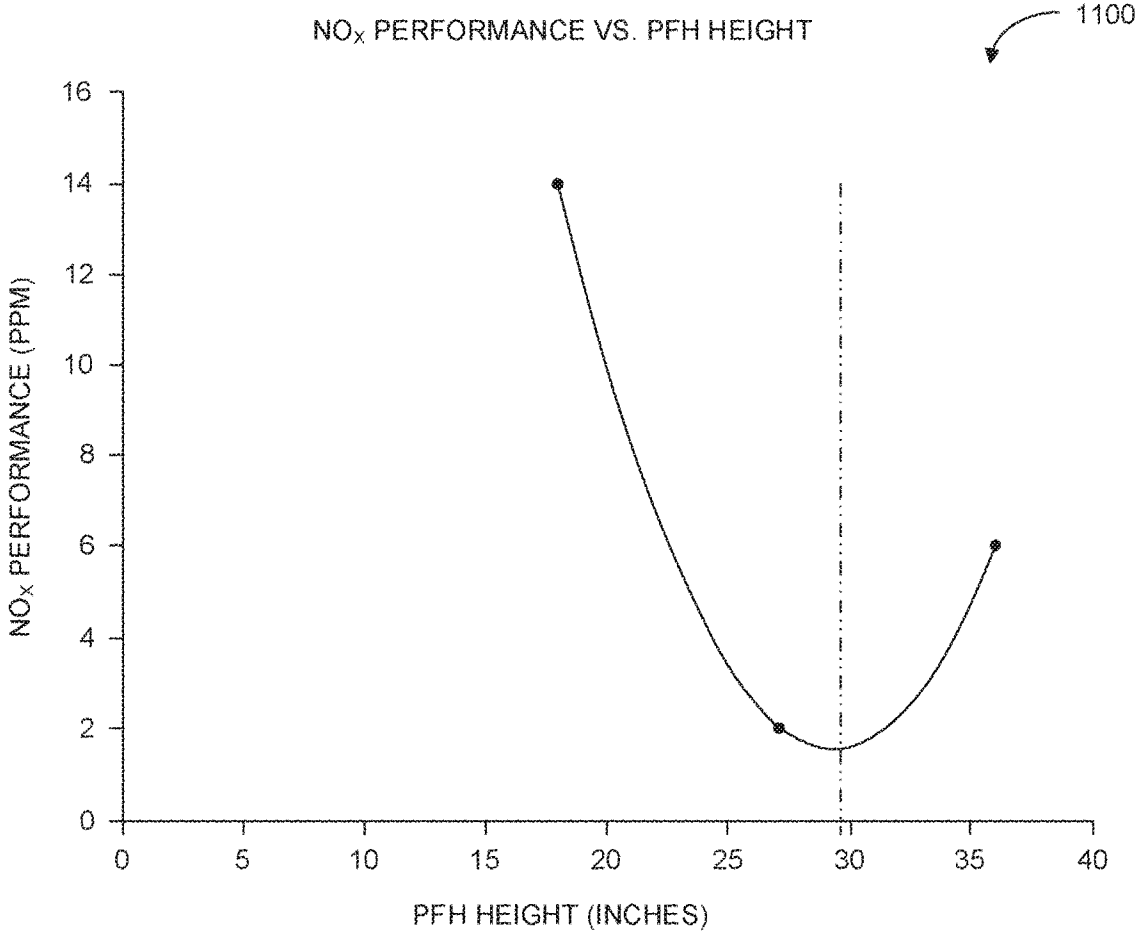
FIG. 11 is a plot of measured and predicted NOx output determined using the apparatus shown in FIG. 10.

FIG. 11 is a plot of measured and predicted NOx concentration (indicated as [NOx]) output determined using the apparatus shown in FIG. 10. The measured results are also shown in TABLE 2. From inspection of FIG. 10 one can see the lowest measured [NOx] occurred at 27" (245 nozzle diameters). A polynomial best fit of the measured data predicts lowest [NOx] at about 29.2" (265 nozzle diameters).

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A method for operating a low oxides of nitrogen (NOx) fire tube boiler, comprising:

providing a boiler shell including at least one combustion pipe disposed at least partially inside the shell and a plurality of fire tubes disposed inside the shell, the plurality of fire tubes being configured to receive combustion products from the combustion pipe, the combustion pipe being characterized by a length and an inside diameter, the boiler shell being structured to hold boiler water, the combustion pipe surrounding a combustion volume and forming a continuous volume with the plurality of fire tubes, and the combustion pipe and fire tubes being configured to collectively hold the boiler water out of the combustion volume;

providing a perforated flame holder including a body that defines a plurality of void volumes operable to convey the fuel and air and to hold a combustion reaction;

supporting the perforated flame holder in the combustion pipe;

outputting fuel and combustion air into the combustion volume in a direction aligned to deliver mixed fuel and combustion air to the perforated flame holder;

holding a combustion reaction supported by the fuel and combustion air with the perforated flame holder;

delivering hot combustion products to the fire tubes;

transferring heat from the fire tubes to the boiler water;

outputting hot water or steam from the boiler; and outputting combustion products including less than 10 parts per million NOx at 3% excess oxygen.

2. The method for operating a low NOx fire tube boiler of claim 1, wherein outputting combustion products including less than 10 parts per million NOx at 3% excess oxygen includes outputting less than 1 part per million NOx.

3. The method for operating a low NOx fire tube boiler of claim 1, further comprising:

receiving heat from the combustion reaction held in the void volumes of the perforated flame holder into the body of the perforated flame holder; and outputting the heat from the body of the perforated flame holder to the mixed fuel and combustion air in the void volumes to maintain combustion.

4. The method for operating a low NOx fire tube boiler of claim 3, wherein void volumes each comprises an elongated aperture.

5. The method for operating a low NOx fire tube boiler of claim 3, wherein outputting heat from the body of the perforated flame holder to the mixed fuel and combustion air includes outputting heat into elongated apertures each having a length L sufficient for thermal boundary layers formed along walls defining the elongated apertures to substantially merge to cause the entirety of the fuel and combustion air to be heated to an autoignition temperature of the fuel in the fuel and combustion air mixture.

6. The method for operating a low NOx fire tube boiler of claim 3, wherein receiving heat from the combustion reaction into the body of the perforated flame holder and outputting the heat from the body of the perforated flame holder to the mixed fuel and combustion air further comprises:

holding the received heat in the body of the perforated flame holder; and transferring the held heat in an upstream direction toward an unburned portion of the fuel and combustion air mixture.

7. The method for operating a low NOx fire tube boiler of claim 6, wherein transferring the held heat in an upstream direction toward an unburned portion of the fuel and combustion air mixture includes transferring heat with thermal radiation within the plurality of void volumes defined by the body of the perforated flame holder.

8. The method for operating a low NOx fire tube boiler of claim 6, wherein transferring the held heat in an upstream direction toward an unburned portion of the fuel and combustion air mixture includes transferring heat with thermal conduction within the body of the perforated flame holder.

9. The method for operating a low NOx fire tube boiler of claim 1, wherein outputting fuel and combustion air into the combustion volume in a direction aligned to deliver mixed fuel and combustion air to the perforated flame holder includes delivering a leaner fuel mixture than what would stably burn in a stream-stabilized flame at a location corresponding to the perforated flame holder.

10. The method for operating a low NOx fire tube boiler of claim 1, wherein void volumes are characterized by a void fraction, expressed as (total perforated flame holder volume−body volume)/total perforated flame holder volume, of about 70% (0.70).

11. The method for operating a low NOx fire tube boiler of claim 1, wherein providing a perforated flame holder includes providing a perforated flame holder wherein the body defines an input surface configured to receive the fuel and air, an output surface opposite to the input surface, and a peripheral surface defining a lateral extent of the perforated flame holder;

wherein the void volumes comprise a plurality of elongated apertures extending from the input surface to the output surface of the perforated flame holder; and wherein holding the combustion reaction with the perforated flame holder includes holding a majority of the combustion reaction to occur between the input surface and the output surface of the perforated flame holder.

12. The method for operating a low NOx fire tube boiler of claim 11, wherein holding the combustion reaction with the perforated flame holder includes holding the combustion reaction at least partially within the elongated apertures; and wherein each elongated aperture has a lateral dimension D equal to or greater than a quenching distance of the fuel in the mixed fuel and combustion air.

13. The method for operating a low NOx fire tube boiler of claim 1, wherein supporting the perforated flame holder in the combustion pipe includes supporting the perforated flame holder with a flame holder support structure away from the fuel nozzle at a distance sufficient to cause delivery of substantially completely mixed fuel and combustion air to the perforated flame holder.

14. The method for operating a low NOx fire tube boiler of claim 1, wherein supporting the perforated flame holder in the combustion pipe further comprises:

supporting thermal insulation adjacent to the wall of the combustion pipe along at least a portion of the distance between a fuel nozzle and the perforated flame holder.

15. The method for operating a low NOx fire tube boiler of claim 1, wherein outputting fuel and combustion air into the combustion volume in a direction aligned to deliver mixed fuel and combustion air to the perforated flame holder further comprises:

outputting a jet of fuel from a fuel nozzle; and outputting combustion air from an air source disposed adjacent to the fuel nozzle.

16. The method for operating a low NOx fire tube boiler of claim 15, wherein outputting a jet of fuel from a fuel nozzle includes outputting a jet of a gaseous hydrocarbon fuel.

17. The method for operating a low NOx fire tube boiler of claim 1, wherein outputting fuel and combustion air into the combustion volume in a direction aligned to deliver mixed fuel and combustion air to the perforated flame holder includes outputting fuel through a fuel nozzle characterized by a nozzle diameter through which the fuel is emitted;

outputting combustion air adjacent to the emitted fuel; and allowing the fuel and combustion air to flow through a mixing distance before reaching the perforated flame holder;

wherein supporting the perforated flame holder in the combustion pipe includes supporting the perforated flame holder with a flame holder support structure at the mixing distance from the fuel nozzle.

18. The method for operating a low NOx fire tube boiler of claim 17, wherein the mixing distance is at least 20 nozzle diameters.

19. The method for operating a low NOx fire tube boiler of claim 17, wherein the mixing distance is 100 nozzle diameters or more.

20. The method for operating a low NOx fire tube boiler of claim 19, wherein the mixing distance is about 265 nozzle diameters.

* * * * *